US006349192B1

(12) United States Patent
Yoshino et al.

(10) Patent No.: US 6,349,192 B1
(45) Date of Patent: Feb. 19, 2002

(54) TANDEM TYPE IMAGE FORMING APPARATUS

(75) Inventors: Naoto Yoshino; Shuji Iseki; Minoru Niwa; Takashi Kawabata; Yukio Hayashi; Masaaki Takahashi; Tatsuya Soga; Yoko Miyamoto; Masao Ohkubo, all of Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 09/651,723

(22) Filed: Aug. 30, 2000

(30) Foreign Application Priority Data

Nov. 30, 1999 (JP) ..... 11-341311

(51) Int. Cl.[7] ..... G03G 15/01
(52) U.S. Cl. ..... 399/302
(58) Field of Search ..... 399/110, 121, 399/124, 298, 299, 302

(56) References Cited

U.S. PATENT DOCUMENTS 5,822,648 A * 10/1998 Mohri ..... 399/302 X
5,943,540 A * 8/1999 Okamoto et al. ..... 399/302
5,983,062 A * 11/1999 Sameshima ..... 399/302
6,035,158 A * 3/2000 Asakura et al. ..... 399/302 X
6,038,411 A * 3/2000 Gotoh ..... 399/298 X

* cited by examiner

*Primary Examiner*—William J. Royer
(74) *Attorney, Agent, or Firm*—Morgan, Lewis & Bockius LLP

(57) ABSTRACT

A tandem type image forming apparatus having plural image forming bodies and an intermediate transfer belt is provided, in which the intermediate transfer belt can be spaced from the image carrying bodies without causing any damage on the intermediate transfer belt. A retracting unit is provided which retracts a belt module along with a secondary transfer module such that a belt-shaped intermediate transfer belt is spaced from all of image carrying bodies.

12 Claims, 27 Drawing Sheets

TANDEM TYPE IMAGE FORMING APPARATUS

BACKGROUND OF THE INVENTION

1. Field of the Invention

The present invention relates to image forming apparatus such as copiers and laser printers employing an electrophotographic system or electrostatic recording system and, more particularly, to configurations of an intermediate transfer module and a secondary transfer module.

2. Description of the Related Art

In general, conventional image forming apparatus such as copiers and laser printers employing an electrophotographic system or electrostatic recording system as described above have a configuration in which image exposure is performed on a surface of a photosensitive drum to form an electrostatic latent image; the electrostatic latent image formed on the surface of he photosensitive drum is developed by a developing device to form a toner image in a predetermined color, and the toner image is directly transferred on to and fixed on recording paper or temporarily transferred to an intermediate transfer body and is thereafter transferred on to the recording paper at a time to form an image.

When a color image is formed by an image forming apparatus as described above, as shown in FIG. 27, a configuration may be employed in which a latent image forming step of performing image exposure on a surface of a single photosensitive drum 200 with an image exposure device 201 to form an electrostatic latent image associated with a predetermined color and a developing step of developing the latent image with a developing device 202 for the associated color are repeated for a predetermined number of colors; toner images T having the predetermined colors sequentially formed on the surface of the photosensitive drum 200 are subjected to primary transfer on to an intermediate transfer belt 203 on a multiplex basis; and the toner images are subjected to secondary transfer from the intermediate transfer belt 203 on to recording paper 204 at a time to form a color image.

Image forming apparatus as described above include so-called tandem type image forming apparatus having plural (e.g., four) photosensitive drums each associated with a predetermined color and having a configuration in which toner images in predetermined colors sequentially formed on surfaces of the respective photosensitive drums are subjected to primary transfer on to an intermediate transfer belt on a multiplex basis; and the toner images are thereafter subjected to secondary transfer from the intermediate transfer belt on to recording paper at a time to form a color image.

For example, as shown in FIG. 29, a tandem type image forming apparatus as described above has four image forming units, i.e., a black image forming unit 300K for forming an image in black (K), a yellow image forming unit 300Y for forming an image in yellow (Y), a magenta image forming unit 300M for forming an image in magenta (M) and a cyan image forming unit 300C for forming an image in cyan (C). The four image forming units 300K, 300Y, 300M and 300C arc horizontally arranged at constant intervals from each other. Below the image forming units 300K, 300Y, 300M and 300C for black (K), yellow (Y), magenta (M) and cyan (C), an intermediate transfer belt 301 for transferring toner images sequentially formed by the respective image forming units in an overlapping relationship with each other is provided such that it is driven by plural rolls 311 through 314 including driving rolls for rotation in the direction indicated by the arrow. For example, the intermediate transfer belt 301 is configured in the form of an endless belt by forming a synthetic resin film made of polyimide or the like having flexibility in the form of a belt and by connecting both ends of the synthetic resin film formed in a belt-like configuration by means of welding or the like.

All of the image forming units 300K, 300Y, 300M and 300C for black (K), yellow (Y), magenta (M) and cyan (C) have the same configuration, and toner images in black (K), yellow (Y), magenta (M) and cyan (C) are sequentially formed by the respective four image forming units 300K, 300Y, 300M and 300C as described above. The image forming units 300K, 300Y, 300M and 300C for the respective colors have a photosensitive drum 302, and a surface of the photosensitive drum 302 is uniformly charged by a scorotron 303 for primary charging and is thereafter scanned and exposed by laser light for image formation from an image exposure device 304 in accordance with image information to form electrostatic latent images. The electrostatic latent images formed on the surface of the photosensitive drums 302 are developed into visible toner images by developing devices 305 of the respective image forming units 300K, 300Y, 300M and 300C with toners in respective colors, i.e., black, yellow, magenta and cyan, and the visible color images are transferred on to the intermediate transfer belt 301 by a transfer charger 306 in an overlapping relationship with each other. The toner images in black, yellow, magenta and cyan transferred on to the intermediate transfer belt 301 on a multiplex basis are transferred at a time on to transfer paper 307 by a secondary transfer roll 315 urged into contact with an opposite roll 314 and are thereafter subjected to a fixing process at a fixing device 308 to form a color image.

Reference numbers 309 and 310 in FIG. 29 represent a photosensitive body cleaner and an intermediate transfer belt cleaner, respectively.

However, the above-described related art has problems as described below. In an image forming apparatus having a configuration as described above, for example, when the intermediate transfer belt is pulled out from the body of the apparatus, the intermediate transfer belt must be spaced from the photosensitive drum. Most image forming apparatus as shown in FIG. 27 have a configuration in which an intermediate transfer belt 203 is spaced from a photosensitive drum 200 by pushing a surface of the intermediate transfer belt 203 with a push-down member 205 and by retracting a primary transfer roll 206 downward, as shown in FIG. 28. In this configuration, a secondary transfer roll 207 is also retracted downward.

In this case, however, since the push-down member 205 must be urged against a surface of the intermediate transfer belt 203, a problem arises in that the intermediate transfer belt 203 can be damaged. In the case of a tandem type image forming apparatus, since an intermediate transfer belt 301 is long and four photosensitive drums 302C, 302M, 302Y and 302K are in contact with the intermediate transfer belt 301 as shown in FIG. 30, it is very difficult to provide a configuration in which the intermediate transfer belt 301 is spaced from the four photosensitive drums 302C, 302M, 302Y and 302K by a push-down member.

In order to allow an intermediate transfer belt to be pulled out from the body of the apparatus while avoiding such problems, a configuration may be employed in which an intermediate transfer belt is held at two positions, i.e., a position where it transfers an image from a photosensitive drum and a position where it is spaced from the photosensitive drum and pulled out and in which a secondary transfer portion has two or more positions including a position where it transfers an image on to recording paper and a position where it is pulled out. When the intermediate transfer belt of such an image forming apparatus is pulled out from the body of the apparatus, the secondary transfer portion must be moved to the pull-out position and the intermediate transfer belt must be thereafter moved to the spaced pull-out portion.

However, the above-described configuration has a problem in that the intermediate transfer belt can be subjected to damage that reduces image quality and the apparatus can be broken in the worst case because the intermediate transfer belt and secondary transfer portion rub and scratch each other when the operation of moving the secondary transfer portion to the pull-out position and the operation of moving the intermediate transfer belt to the spaced pull-put position are carried out in a wrong order or when the intermediate transfer belt is moved to the spaced pull-out position without moving the secondary transfer portion.

Further, in the above-described configuration, a great operating force is required to move the intermediate transfer belt and the like and a mechanism for moving them becomes complicated when a moving handle for moving the intermediate transfer belt and secondary transfer portion is not located near the positions of the intermediate transfer belt and secondary transfer portion, which results in a problem in that the intermediate transfer belt and secondary transfer portion may not be properly positioned.

SUMMARY OF THE INVENTION

The present invention has been made to overcome the above problems and provides a so-called tandem type image forming apparatus having plural image carrying bodies and an intermediate transfer belt in which the intermediate transfer belt can be spaced from the image carrying bodies without causing any damage on the intermediate transfer belt.

The present invention also provides an image forming apparatus free from the possibility of damage and the like of the apparatus and an intermediate transfer belt even when it has a configuration in which an intermediate transfer belt is held at two positions, i.e., a position where it transfers an image from an image carrying body and a position where it is spaced from the image carrying body and pulled out and in which a secondary transfer portion has a position where it transfers an image on to a recording material and a position where it is pulled out.

The present invention also provides an image forming apparatus in which an operating force for moving the positions of an intermediate transfer belt and a secondary transfer portion can be reduced and in which a mechanism for moving the positions of the intermediate transfer belt and the secondary transfer portion can be simplified.

In order to solve the above problems, according to a first aspect of the invention, an image forming apparatus has a configuration in which there is provided plural image carrying bodies which form visible images using charged colorants in colors different from each other, a belt-shaped intermediate transfer body to which primary transfer of the visible images formed by the plural image carrying bodies is carried out and which circulates with the visible images formed of the charged colorant carried thereon, a secondary transfer member which transfers the visible images transferred onto the belt-shaped intermediate transfer belt to a recording material at a time, a belt module which supports the belt-shaped intermediate transfer body such that it can circulate and a secondary transfer module which supports the secondary transfer member such that it is urged into contact with or close to the belt-shaped intermediate transfer body supported by the belt module and a retracting unit which retracts the belt module along with the secondary transfer module such that the belt-shaped intermediate transfer body is spaced from all of the image carrying bodies.

According to a second aspect of the invention, an image forming apparatus according to the first aspect has a configuration including a first retracting unit which retracts the belt module such that the belt-shaped intermediate transfer body is spaced from all of the image carrying bodies and a second retracting unit which retracts the secondary transfer module such that a secondary transfer member is spaced from the position in contact with or close to the belt-shaped intermediate transfer body.

Further, according to a third aspect of the invention, an image forming apparatus according to the first or second aspect has a configuration including a first pull-out unit which pulls out the belt module from the body of the image forming apparatus and a second pull-out unit which pulls out the secondary transfer module from the body of the image forming apparatus.

Furthermore, according to a fourth aspect of the invention, an image forming apparatus according to the second or third aspect has a configuration in which the first retracting unit retracts the belt module such that the belt-shaped intermediate transfer body is spaced from all of the image carrying bodies after the secondary transfer module is retracted by the second retracting unit such that it is spaced from the belt-shaped intermediate transfer body.

Further, according to a fifth aspect of the invention, an image forming apparatus according to the fourth aspect has a configuration including an erroneous operation preventing unit which prevents the operation of the first retracting unit to retract the belt module such that the belt-shaped intermediate transfer body is spaced from all of the image carrying bodies before the secondary transfer module is retracted by the second retracting unit such tat it is spaced from the belt-shaped intermediate transfer body.

Further, according to a sixth aspect of the invention, in an image forming apparatus according to the fifth aspect, the erroneous operation preventing unit is configured to disable the operation of the firs retracting unit to retract the belt module such that the belt-shaped intermediate transfer body is spaced from all of the image carrying bodies unless the secondary transfer module is retracted by the second retracting unit such that it is spaced from the belt-shaped intermediate transfer body.

Furthermore, according to a seventh aspect of the invention, in an image forming apparatus according to the sixth aspect, the erroneous operation preventing unit is constituted by a part of a handle member of the first retracting unit which retracts the belt module such that the belt-shaped intermediate transfer body is spaced from all of the image carrying bodies and a part of the secondary transfer module, Further, according to an eighth aspect of the invention, an image forming apparatus according to the seventh aspect has a configuration in which the handle member of the first retracting unit is provided in the vicinity of a positioning portion of the belt module.

Further, according to a ninth aspect of the invention, an image forming apparatus according to the seventh or eighth aspect has a configuration in which the handle member of the first retracting unit is normally covered by a protective cover which is not opened and closed by a user.

According to a tenth aspect of the invention, there is provided a configuration including plural image carrying bodies, a belt-shaped intermediate transfer body to which primary transfer of visible images formed by the plural image carrying bodies is carried out and which circulates with the visible images carried thereon, a belt module which supports the belt-shaped intermediate transfer body such that it can be circulate, a secondary transfer module which supports a secondary transfer member such that it is urged into contact with or close to the belt-shaped intermediate transfer body supported by the belt module, a backup roll facing the secondary transfer member with the belt interposed therebetween, which supports the intermediate transfer belt from a back side thereof, an insulated casing which can be attached to and detached from the belt module, which is open at least in a region thereof facing the intermediate transfer belt and which contains and supports the backup roll and a retracting unit which retracts the belt module along with the secondary transfer module such that the belt-shaped intermediate transfer body is spaced from all of the image carrying bodies.

According to an eleventh aspect of the invention, there is provided a configuration including an image carrying body on which a toner image according to image information is formed, an intermediate transfer belt to which primary transfer of the toner image from the image carrying body is carried out, a transfer member which performs secondary transfer of the toner image on to a recording sheet by sandwiching the recording sheet with the intermediate transfer belt and itself, a backup roll provided in a face-to-face relationship with the transfer member with the intermediate transfer belt interposed therebetween, which supports the intermediate transfer belt from a back side thereof and an insulated casing which is open at least in a region thereof facing the intermediate transfer belt and which contains and supports the backup toll.

Finally, according to a twelfth aspect of the invention, there is provided a configuration in which the insulated casing and the backup roll contained in and supported by the insulated casing can be simultaneously attached and detached in the axial direction.

According to the first aspect of the invention, there is provided a configuration including a retracting unit which retracts a belt module along with a secondary transfer module such that a belt-shaped intermediate transfer body is spaced from all of image carrying bodies. As a result, the belt-shaped intermediate transfer belt can be spaced from all of the image carrying bodies without any damage to the belt-shaped intermediate transfer body because the belt module can be retracted by the retracting unit such that the belt-shaped intermediate transfer body is spaced from all of the image carrying bodies.

According to the second aspect of the invention, there is provided a configuration including a first retracting unit which retracts the belt module such that the belt-shaped intermediate transfer body is spaced from all of the image carrying bodies and a second retracting unit which retracts the second transfer module such that a second transfer member is spaced from a position in contact with or close to the belt-shaped intermediate transfer body. As a result, the first retracting unit can prevent the secondary transfer module from hindering the belt module from spacing the belt-shaped intermediate transfer body from all of the image carrying bodies.

Further, according to the third aspect of the invention, there is provided a configuration including a first pull-out unit which pulls out the belt module from the body of the image forming apparatus and a second pull-out unit which pulls out the secondary transfer module from the body of the image forming apparatus. As a result, the possibility of damage or breakage of the belt-shaped intermediate transfer body can be eliminated even in a configuration in which the intermediate transfer belt is held at two positions, i.e., a position where it transfers images from the image carrying bodies and a position where it is spaced from the image carrying bodies and pulled out and in which the secondary transfer portion has a position where it transfers we images on to a recording material and a position where it is pulled out.

Furthermore, according to the fourth aspect of the invention, the first retracting unit retracts the belt module such that the belt-shaped intermediate transfer body is spaced from all of the image carrying bodies after the secondary transfer module is retracted by the second retracting unit such that it is spaced from the belt-shaped intermediate transfer body. As a result, the first retracting unit can prevent the secondary transfer module from hindering the belt module from spacing the belt-shaped intermediate transfer body from all of the image carrying bodies.

Further, according to the fifth aspect of the invention, there is provided a configuration including an erroneous operation preventing unit which prevents the operation of the first retracting unit to retract the belt module such that the belt-shaped intermediate transfer body is spaced from all of the image carrying bodies before the secondary transfer module is retracted by the second retracting unit such that it is spaced from the belt-shaped intermediate transfer body. As a result, the erroneous operation preventing unit can prevent the first retracting unit from erroneously retracting the belt module first, thereby preventing the belt module from striking against other members to cause damage thereon.

Further, according to the sixth aspect of the invention, there is provided a configuration in which the erroneous operation preventing unit disables the operation of the first retracting unit to retract the belt module such that the belt-shaped intermediate transfer body is spaced from all of the image carrying bodies unless the secondary transfer module is retracted by the second retracting unit such that it is spaced from the belt-shaped intermediate transfer body. As a result, the erroneous operation preventing unit can prevent the first retracting unit from erroneously retracting the belt module first, thereby preventing the belt module from striking against other members to cause damage thereon with improved reliability.

Furthermore, according to the seventh aspect of the invention, there is provided a configuration in which the erroneous operation preventing unit is constituted by a part of a handle member of the first retracting unit which retracts the belt module such that the belt-shaped intermediate transfer body is spaced from all of the image carrying bodies and a part of the secondary transfer module. It is therefore possible to more reliably prevent the belt module from striking against other members to cause damage thereon without a complicated configuration.

Further, according to the eighth aspect of the invention, there is provided a configuration in which the handle member of the first retracting unit is provided in the vicinity of a positioning portion of the belt module. It is therefore possible to reduce an operating force required to move the belt-shaped intermediate transfer body and secondary transfer portion.

Further, according to the ninth aspect of the invention, there is provided a configuration in which the handle member of the first retracting unit is normally covered by a protective cover which is not opened and closed by a user. It is possible to reliably prevent a user from erroneously operating the handle member of the first retracting unit.

According to the tenth, eleventh and twelfth aspects of the invention, since a backup roll is supported by a casing, the casing can be detachable using a rail which is not shown to be replaced easily even if it is worn as a result of rotation.

BRIEF DESCRIPTION OF THE DRAWINGS

A preferred embodiment of the present invention will be described in detail based on the following figures, wherein.

DETAILED DESCRIPTION OF THE PREFERRED EMBODIMENT

A preferred embodiment of the invention will now be described with reference to the drawings.

Figure 1:
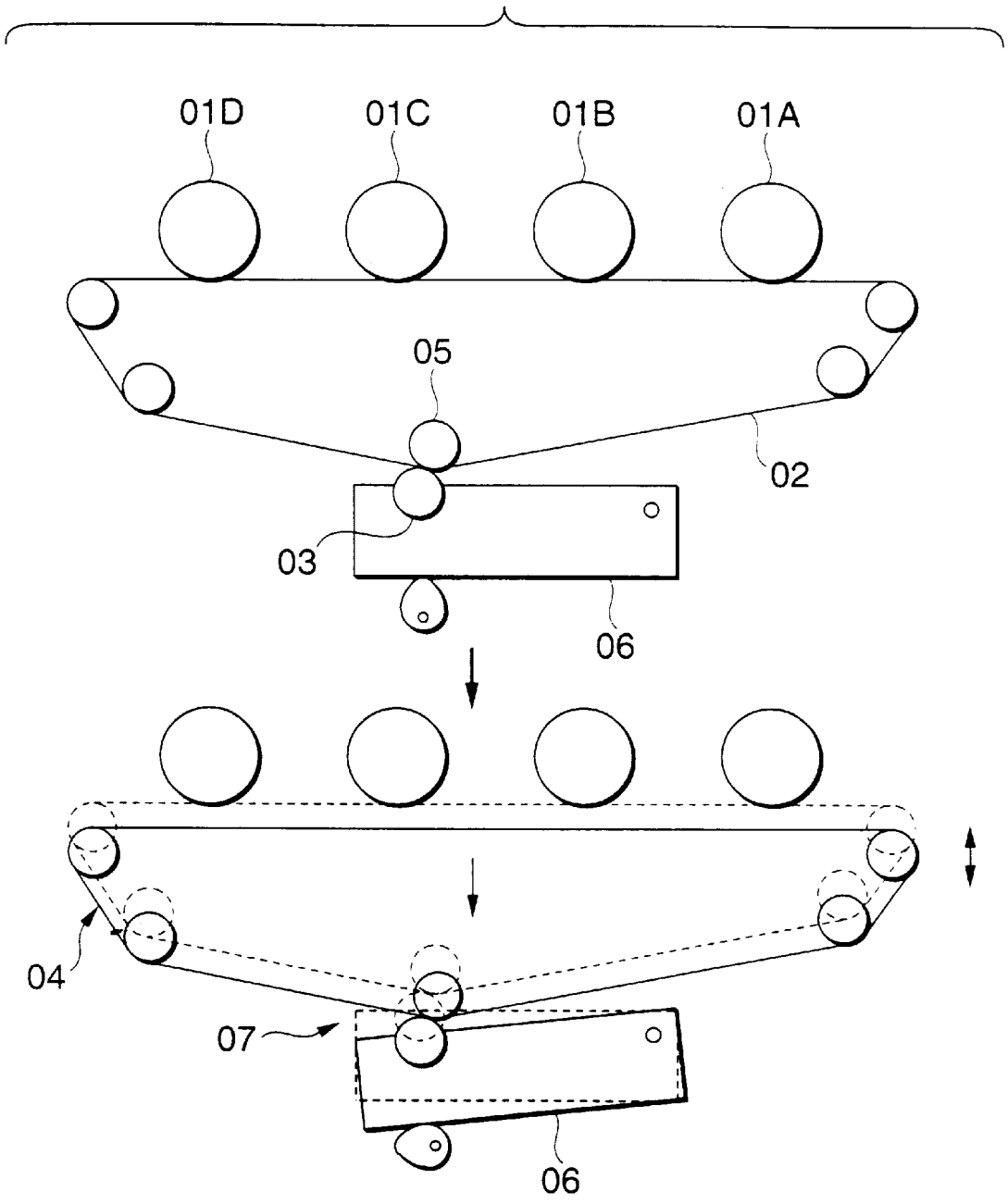
FIG. 1 is a schematic view of an image forming apparatus according to an embodiment of the invention.

FIG. 1 shows an image forming apparatus according to an embodiment of the present invention. In the figure, there is provided plural image carrying bodies 01A, 01B, 01C and 01D which form visible images using charged colorants in colors different from each other, a belt-shaped intermediate transfer body 02 to which primary transfer of the visible images formed by the plural image carrying bodies 01A, 01B, 01C and 01D is carried out and which circulates with the visible images formed of the charged colorant carried thereon, a secondary transfer member 03 which transfers the visible images transferred on to the belt-shaped intermediate transfer body 02 to a recording material at a time, a belt module 04 which supports the belt-shaped intermediate transfer body 02 such that it can circulate and a secondary transfer module 06 which supports the secondary transfer member 03 such that it is urged into contact with or close to the belt-shaped intermediate transfer body 02 supported by the belt module 04 and in which there is provided a retracting unit 07 which retracts the belt module 04 along with the secondary transfer module 06 such that the belt-shaped intermediate transfer body 02 is spaced from all of the image carrying bodies 01A, 01B, 01C and 01D.

Figure 2:
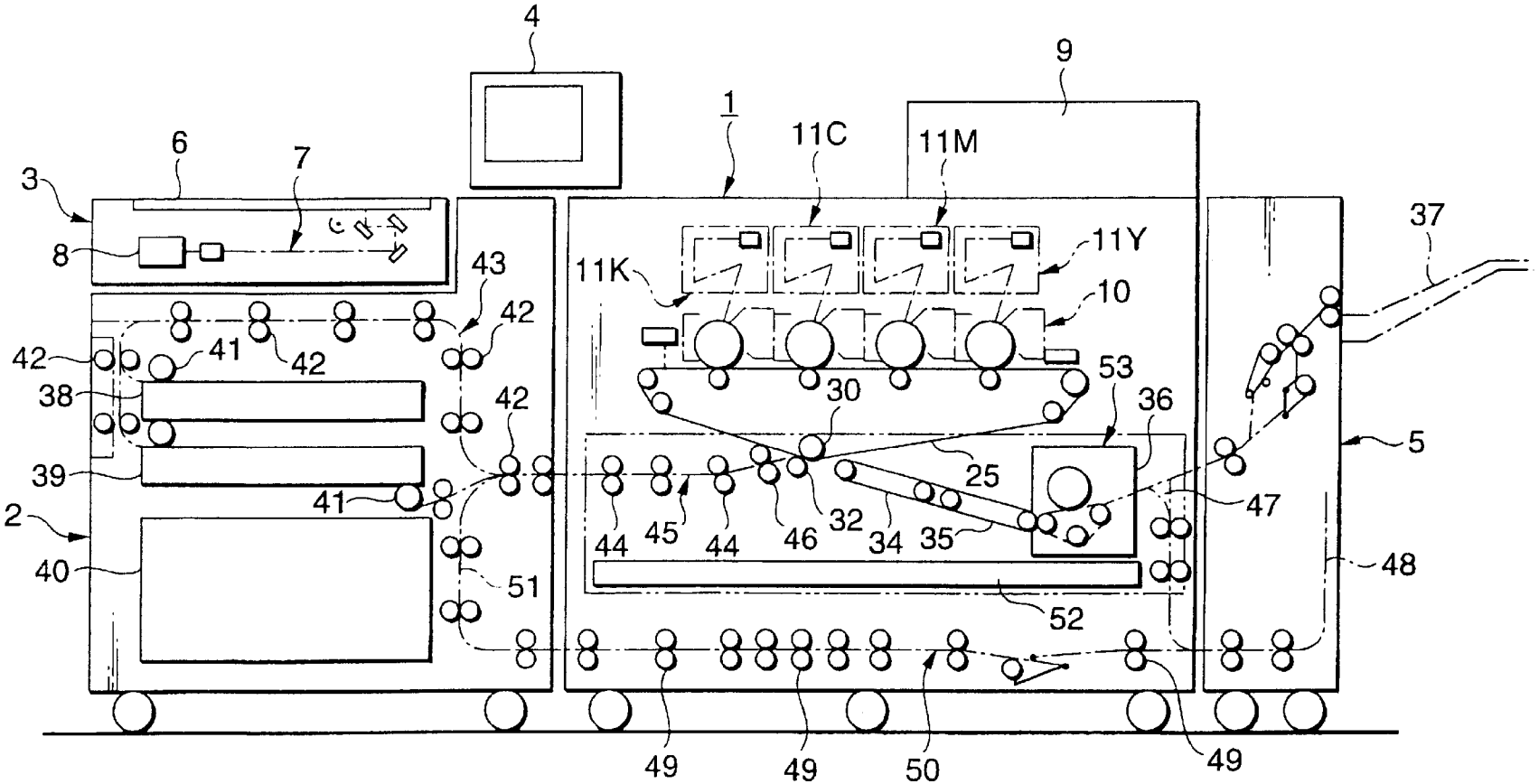
FIG. 2 is a configuration diagram of a digital color printer as an image forming apparatus according to the embodiment of the invention.

FIG. 2 shows a tandem type digital color printer as an image forming apparatus according to the embodiment of the invention.

As shown in FIG. 2, the tandem type digital color printer has an image recorder main unit 1, a paper feeding device 2 provided on one side (left side in FIG. 2) of the image recorder main unit 1 for feeding recording paper as a recording material in a predetermined size to the image recorder main unit 1, an image input terminal 3 placed on top of the paper feeding device 2, a user interface 4 provided across top portions of the paper feeding device 2 and image recorder main unit 1, having a display screen for operations such as setting conditions for an image forming operation and a paper discharge device 5 provided on the other side (right side in FIG. 2) of the image recorder main unit 1 for discharging recording paper with images thereon formed in the image recorder main unit 1 after performing a post process such as removing a curl of the recording paper as needed.

Figure 3:
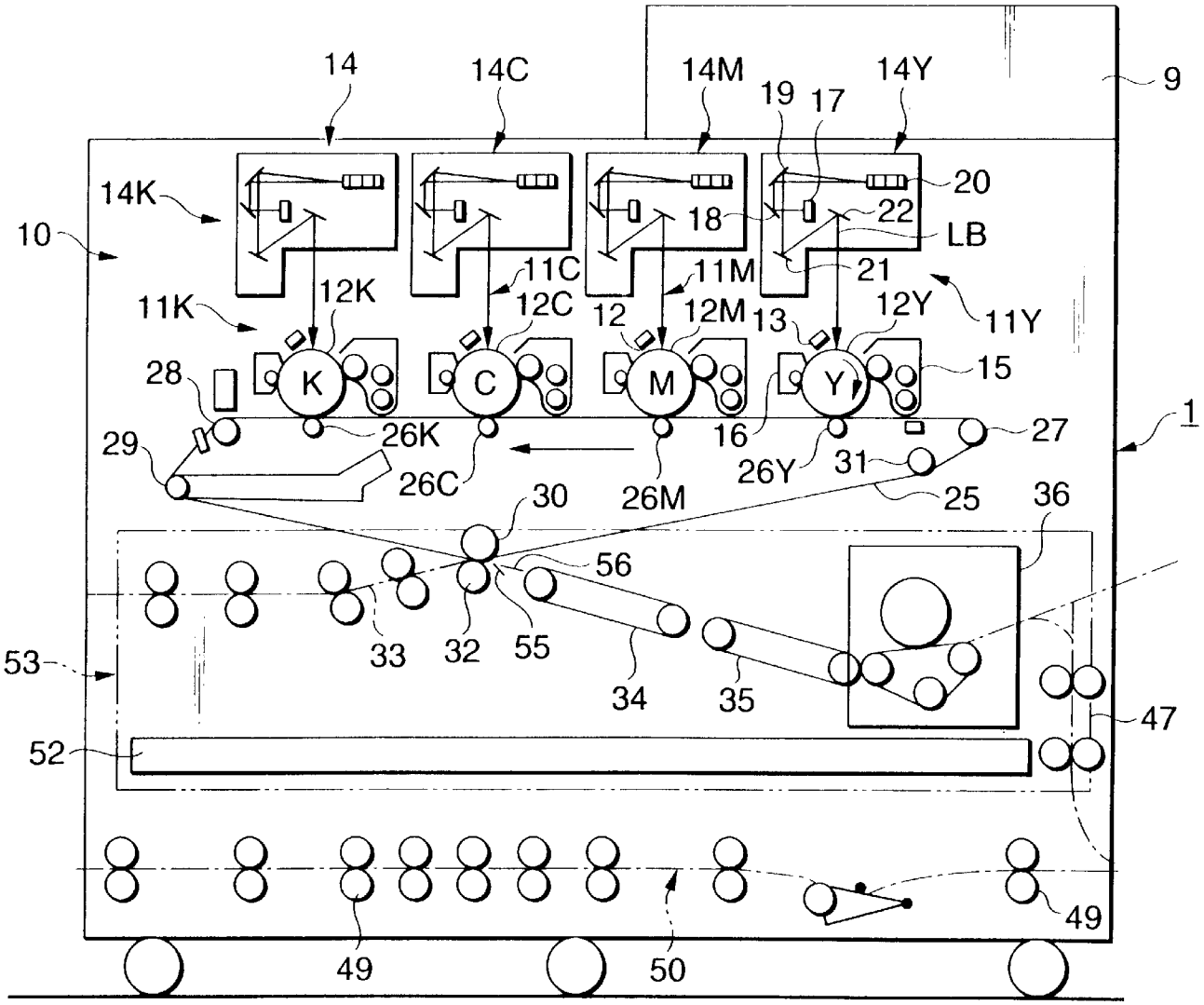
FIG. 3 is a configuration diagram of a main unit of an image recorder main unit of the digital color printer as an image forming apparatus according to the embodiment of the invention.

FIG. 3 shows the image recorder main unit 1 of the tandem type digital color printer.

For example, image data of an original read by the above-described image input terminal 3 are input to the image recorder main unit 1. The image recorder main unit 1 is connected to a host computer such as a personal computer which is not shown through a network such as a LAN as needed, and image data are sent to the same from the host computer or the like.

As shown in FIG. 2, the image input terminal 3 has a configuration in which an original (not shown) placed on a platen glass 6 is illuminated by a light source; an image of light reflected by the original is scanned and exposed on an image reading element 8 constituted by a CCD or the like through a reducing optical system 7 constituted by plural mirrors and an imaging lens; and the image reading element 8 reads an image of light reflected by colorants on the original in a predetermined dot density (for example, 16 dots/mm).

The image of light reflected by colorants on the original read by the image input terminal 3 is sent to an image processing device (not shown) as original reflectivity data in three colors i.e., red, green and blue (having eight bits each), and the image processing device performs predetermined image processes such as correction of shading, correction of misalignment, conversion of the brightness and color space, gamma correction, frame elimination, edition of colors and movement on the reflectivity data of the original.

The image data which have been subjected to the predetermined image processes at the image processing device as described above are converted into original colorant tone data of four colors, i.e., yellow (Y), magenta (M), cyan (C) and black (BK) (having eight bits each) and are output to an image output device 10 disposed in the image recorder main unit 1.

As shown in FIG. 3, the image output device 10 has four image forming units 11Y, 11M, 11C and 11K associated with yellow (Y), magenta (M), cyan (C) and black (BK), and the four image forming units 11Y, 11M, 11C and 11K are horizontally provided in the image recorder main unit 1 in parallel at constant intervals.

All of the four image forming units 11Y, 11M, 11C and 11K have the same configuration and are generally constituted by a photosensitive drum 12 as the image carrying body rotating at a predetermined speed in the direction indicated by the arrow, a scorotron 13 as a primary charging device for uniformly charging a surface of the photosensitive drum 12, an ROS (raster output scanner) 14 as an image exposure unit for exposing an image associated with a predetermined color on the surface of the photosensitive drum 12 to form an electrostatic latent image, a developing device 15 for developing the latent image formed on the photosensitive drum 12 with a toner in the predetermined color and a cleaning device 16 for removing untransferred toner remaining on the photosensitive drum 12, In the image output device 10, as shown in FIG. 3, original colorant tone data of four colors yellow (Y), magenta (M), cyan (C) and black (BK) (having eight bits each) output by the image processing device are sent to the ROSs 14Y, 14M, 14C and 14K of the image forming units 11Y, 11M, 11C and 11K for yellow (Y), magenta (M), cyan (C) and black (BK) respectively, and the ROSs 14Y, 14M, 14C and 14K perform image exposure with laser beams LB according to the original colorant tone data of the predetermined colors.

In the ROSs 14Y, 14M, 14C and 14K, as shown in FIG. 3, semiconductor lasers 17 are modulated according to the original colorant tone data, and the semiconductor lasers 17 emit laser beams LB according to the tone data. The laser beams LB emitted by the semiconductor lasers 17 are polarized and scanned by rotating polyhedral lenses 20 through reflecting mirrors 18 and 19 and are scanned again to expose the photosensitive drums 12 through the reflecting mirrors 19 and plural reflecting mirrors 21 and 22.

As described above, the image processing device sequentially outputs image data of the respective colors to the ROSs 14Y, 14M, 14C and 14K of the respective image forming units 11Y, 11M, 11C and 11K for yellow (Y), magenta (M), cyan (C) and black (K), and the ROSs 14Y, 14M, 14C and 14K scan laser beams LB modulated according to the image data to expose the surfaces of the respective photosensitive drums 12Y, 12M, 12C and 12K, thereby forming electrostatic latent images. The electrostatic latent images formed on the photosensitive drums 12Y, 12M, 12C and 12K are developed into toner images in yellow (Y), magenta (M), cyan (C) and black (K) by respective developing devices 15. Reference number 9 in FIGS. 2 and 3 represents a toner cartridge box which contains toner cartridges for supplying toners in predetermined colors to the developing devices 15.

Toner images in yellow (Y), magenta (M), cyan (C) and black (K) sequentially formed on the photosensitive drums 12 of the image forming units 11Y, 11M, 11C and 11K are transferred by primary transfer rolls 26Y, 26M, 26C and 26K on a multiplex basis on to an intermediate transfer belt 25 as a belt-shaped intermediate transfer body provided under the image forming units 11Y, 11M, 11C and 11K. The intermediate transfer belt 25 is stretched at a constant tension between a driving roll 27, a driven roll 28, a tension roll 29, a backup roll 30 for secondary transfer and an idle roll 31 and is driven for circulation at a predetermined speed in the direction indicated by the arrow by the driving roll 27 which is driven for rotation by a dedicated driving motor (not shown) having excellent constant speed properties. As the intermediate transfer belt 25, for example, a part may be used which is formed like an endless belt by forming a synthetic resin film having flexibility such as polyimide in a belt-like configuration and by connecting both ends of the synthetic resin film formed in a belt-like configuration by means of welding or the like.

The toner images in yellow (Y), magenta (M), cyan (C) and black (K) transferred on a multiplex basis on to the intermediate transfer belt 25 are subjected to secondary transfer on to recording paper 33 as a recording material using a pressure or an electrostatic force performed by a secondary transfer roll 32 which is urged against the backup roll 30 with the intermediate transfer belt 25 interposed therebetween, and the recording paper 33 having the toner images in the respective colors transferred thereon is transported to a fixing device 36 by a pair of paper-absorbing transport belts 34 and 35. The recording paper 33 having the toner images in the respective colors transferred thereon is subjected to a fixing process at the fixing device 36 utilizing heat and pressure and is discharged on to a discharge tray 37 through a paper discharge device 5 provided outside the image recorder main unit 1 as shown in FIG. 2 in the case of single-side printing.

As shown in FIG. 2, recording paper 33 in a predetermined size is fed by a paper feed roller 41 from any of plural paper cassettes 38, 39 and 40 of the paper feeding device 2 provided on one side (left side in FIG. 2) of the image recorder main unit 1 and is transported into the image recorder main unit 1 through a paper feeding path 43 having a pair of paper transport rollers 42. The recording paper 33 transported into the image recorder main unit 1 is transported to a registration roller 46 through a paper transport path 45 having plural pairs of paper transport rollers 44 and is then temporarily stopped there. The recording paper 33 is sent to a position for secondary transfer when the backup roll 30 and secondary transfer roll 32 are urged against each other on the intermediate transfer belt 25 by the registration roller 46 which is driven for rotation at predetermined timing in synchronism with the toner images transferred on to the intermediate transfer belt 25.

When color images are to be recorded on both sides of recording paper 33 in the image recorder main unit 1, the transporting direction of recording paper 33 having an image recorded on one side thereof is shifted downward by a paper-inverting transport member 47 provided at a paper discharge portion of the image recorder main unit 1 instead of discharging the paper on to the discharge tray 37 as it is through the paper discharge device 5. The recording paper 33 having an image recorded on one side thereof is transported to a paper inverting path 48 provided at a lower end of the paper discharge device 5 by the paper-inverting transport member 47 and is temporarily stopped there. The recording paper 33 is then transported back into the image recorder main unit 1 with the transporting direction thereof inverted and is transported into the paper feeding device 2 through a paper-inverting transport path 50 having plural pairs of paper transport rollers 49 provided at the bottom of the image recorder main unit 1. Thereafter, the recording paper 33 having an image recorded on one side thereof is transported through a paper-inverting transport path 51 provided in the paper feeding device 2 to be transported again to the position for secondary transfer on the intermediate transfer belt 25 at predetermined timing through the paper transport path 45 having the plural pairs of paper transport rollers 44 and the registration roller 46 similarly to normal recording paper 33 with the other side thereof facing upward. Then, an image is recorded on the other side of the recording paper 33. The recording paper 33 having color images recorded on both sides thereof is discharged on to the discharge tray 37 through the paper discharge device 5, and this terminates the double-side color image recording process.

When a monochromatic image is formed in the tandem type digital color printer having the above-described configuration, an unfixed toner image T which has been subjected to primary transfer on to the intermediate transfer belt 25 is immediately subjected to secondary transfer on to recording paper 33. When a color image is formed by overlapping toner images T in plural colors, a step is performed to sequentially form toner images T in predetermined colors on the photosensitive drums 12Y, 12M, 12C and 12K and to perform primary transfer of the toner images T on to the intermediate transfer belt 25 on a multiplex basis.

For example, when a full-color image is to be formed by overlapping toner images T in four colors, i.e., yellow (Y), magenta (M), cyan (C) and black (BK), toner images T in yellow (Y), magenta (M), cyan (C) and black (BK) are sequentially formed on the photosensitive drums 12Y, 12M, 12C and 12K, and the toner images in four colors are sequentially subjected to primary transfer on to the intermediate transfer belt 25 in an overlapping relationship.

The intermediate transfer belt 25 rotates in a cycle in synchronism with the photosensitive drums 12 with an unfixed toner image T in yellow which has been first subjected to the primary transfer retained thereon, and unfixed toner images T in magenta, cyan and black are sequentially transferred in an overlapping relationship with the unfixed toner image T in yellow in positions on the intermediate transfer belt 25 determined by a position detecting sensor which is not shown.

The unfixed toner images T thus subjected to primary transfer to the intermediate transfer belt 25 are transported to the position for secondary transfer facing the transporting path of recording paper 33 as a result of the rotation of the intermediate transfer belt 25.

As described above, the recording paper 33 is fed by the feed roll 41 from a predetermined one of the paper cassettes 38, 39 and 40, transported to the registration roller 46 by the transport roll 42, and supplied to a nip between the secondary transfer roll 32 and intermediate transfer belt 25 at predetermined timing by the registration roller 46.

The backup roll 30 serving as a counter electrode for the secondary transfer roll 32 is provided on the side of the back surface of intermediate transfer belt 25 in the position for secondary transfer. In the position for secondary transfer, the semiconductive secondary transfer roll 32 is urged into contact with the intermediate transfer belt 25 at predetermined timing to apply a voltage having the polarity opposite to the polarity with which the toner is charged to the backup roll 30, which causes electrostatic secondary transfer of the unfixed toner images T transferred to the intermediate transfer belt 25 on to the recording paper 33 in the position for secondary transfer.

In this embodiment, instead of directly applying a voltage with the polarity opposite to the charging polarity of the toner to the secondary transfer roll 32, a configuration is employed in which a bias roll (not shown) applies a voltage having the same polarity as the charging polarity of the toner to the backup roll 30 urged into contact with the secondary transfer roll 32 with the intermediate transfer belt 25 interposed through a high voltage source for a transfer bias as transfer bias voltage applying unit. However, a configuration may obviously be employed in which a voltage having the same polarity as the charging polarity of the toner is directly applied to the secondary transfer roll 32.

The recording paper 33 having unfixed toner images T transferred thereon is peeled off from the intermediate transfer belt 25 and fed to the fixing device 36 by an electrode member 55, a guide plate 56 and the sport belts 34 and 35 provided downstream of the secondary transfer portion to perform a fixing process on the unfixed toner images T.

When the secondary transfer of the unfixed toner images T is completed, residual toner on the intermediate transfer belt 25 is removed by a cleaner for the intermediate transfer belt which is not showy.

The intermediate transfer belt 25 used here is obtained by adding an appropriate amount of an antistatic agent such as carbon black to a synthetic resin such as polyimide, polycarbonate, polyester or polypropylene or any of various kinds of rubber and is formed such that it has volume resistivity in the range from $10^9$ to $10^{12}$ Ω·cm. For example, the thickness of the intermediate transfer belt 25 is set at 0.1 mm. The circumference of the intermediate transfer belt 25 is set at an integral multiple (e.g., eight times) of the circumference of the photosensitive drum 12.

The secondary transfer roll 32 and the cleaner for the intermediate transfer belt are disposed such that they can be put into contact with and spaced from the intermediate transfer belt 25. When a color image is to be formed, at least the cleaner for the intermediate transfer belt is spaced from the intermediate transfer belt 25 until the unfixed toner image T of the last color is subjected to primary transfer on to the intermediate transfer belt 25.

The secondary transfer roll 32 has a surface layer constituted by a tube made of urethane rubber in which carbon is dispersed and an internal layer made of foam urbane rubber in which carbon is dispersed. The surface of the secondary transfer roll 32 is coated with fluorine. The secondary transfer roll 32 is set at volume resistivity in the range from $10^3$ to $10^{10}$ Ω·cm and is formed to have a roll diameter ϕ of 28 mm. The hardness of the same is set at, for example, 30° (ASKER C.).

The backup roll 30 has a surface layer constituted by rubber tube obtained by blending EPDM and NBR in which carbon is dispersed and an internal layer made of EPDM rubber. It has surface resistivity in the range from $10^7$ to $10^{10}$ Ω/□ and is formed to have a roll diameter ϕ of 28 mm. The hardness of the same is set at, for example, 70° (ASKER C.).

The electrode member 55 provided downstream of the nip of the position for secondary transfer is a conductive sheet-like member which is preferably a metal plate. In this embodiment, a sheet of stainless steel is used which has a thickness of 0.5 mm and which has a needle-like feature on the side thereof toward the recording paper 33. The end of the electrode member 55 toward the region for secondary transfer is biased by 1 mm toward the secondary transfer roll 32 from a line defined by the nip between the backup roll 30 and secondary transfer roll 32 and is 7 mm apart from the exit of the nip.

A tandem type digital color printer according to this embodiment has a belt module which supports a belt-shaped intermediate transfer body such that it can circulate and a secondary transfer module which supports a secondary transfer roll such that it is urged against an opposite roll supporting the belt-shaped intermediate transfer body and has a configuration including a retracting unit which retracts the belt module along with the secondary transfer module such that the belt-shaped intermediate transfer body is spaced from all of image carrying bodies.

Further, according to the embodiment, the belt module has a configuration including a first retracting unit which retracts the belt module such that the belt-shaped intermediate transfer body is spaced from all of the image carrying bodies and a second retracting unit which retracts the secondary transfer module such that the secondary transfer roll is spaced from the opposite roll.

Figure 4:
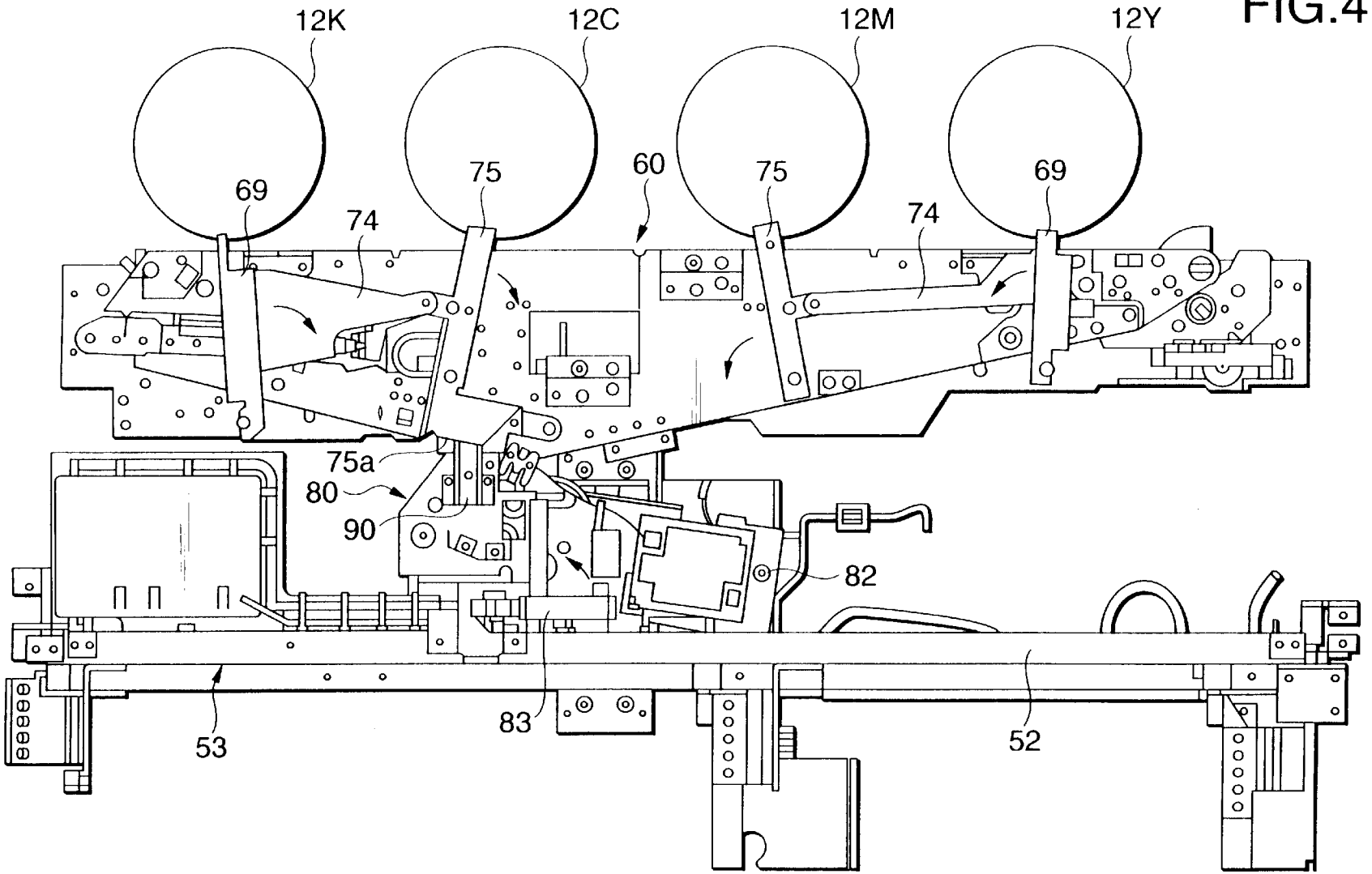
FIG. 4 is a front view of a retracting unit of the image forming apparatus according to the embodiment of the invention.
Figure 5:
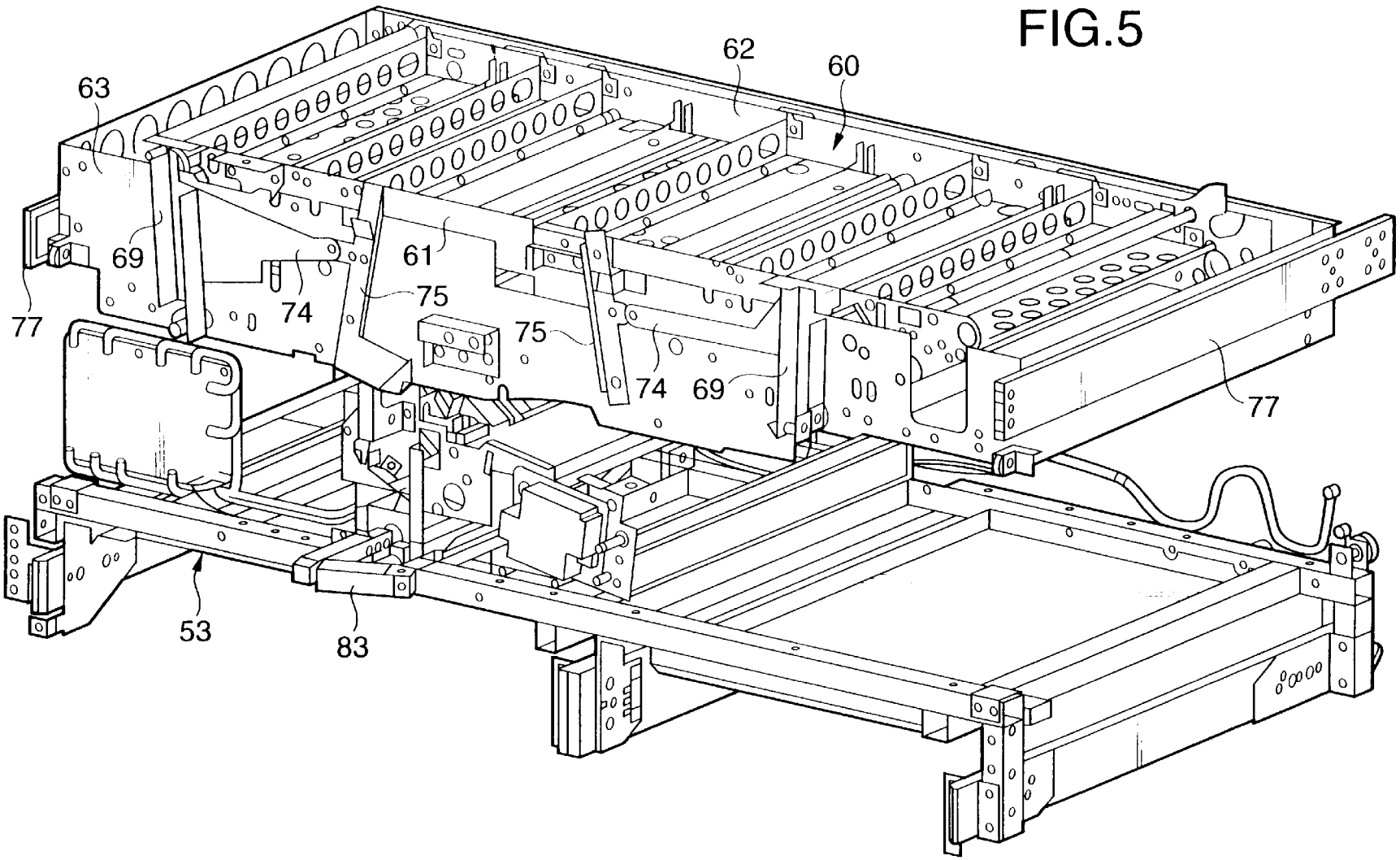
FIG. 5 is a perspective view of the retracting unit.

FIGS. 4 and 5 show the belt module for supporting the intermediate transfer belt such that it can circulate.

Figure 6:
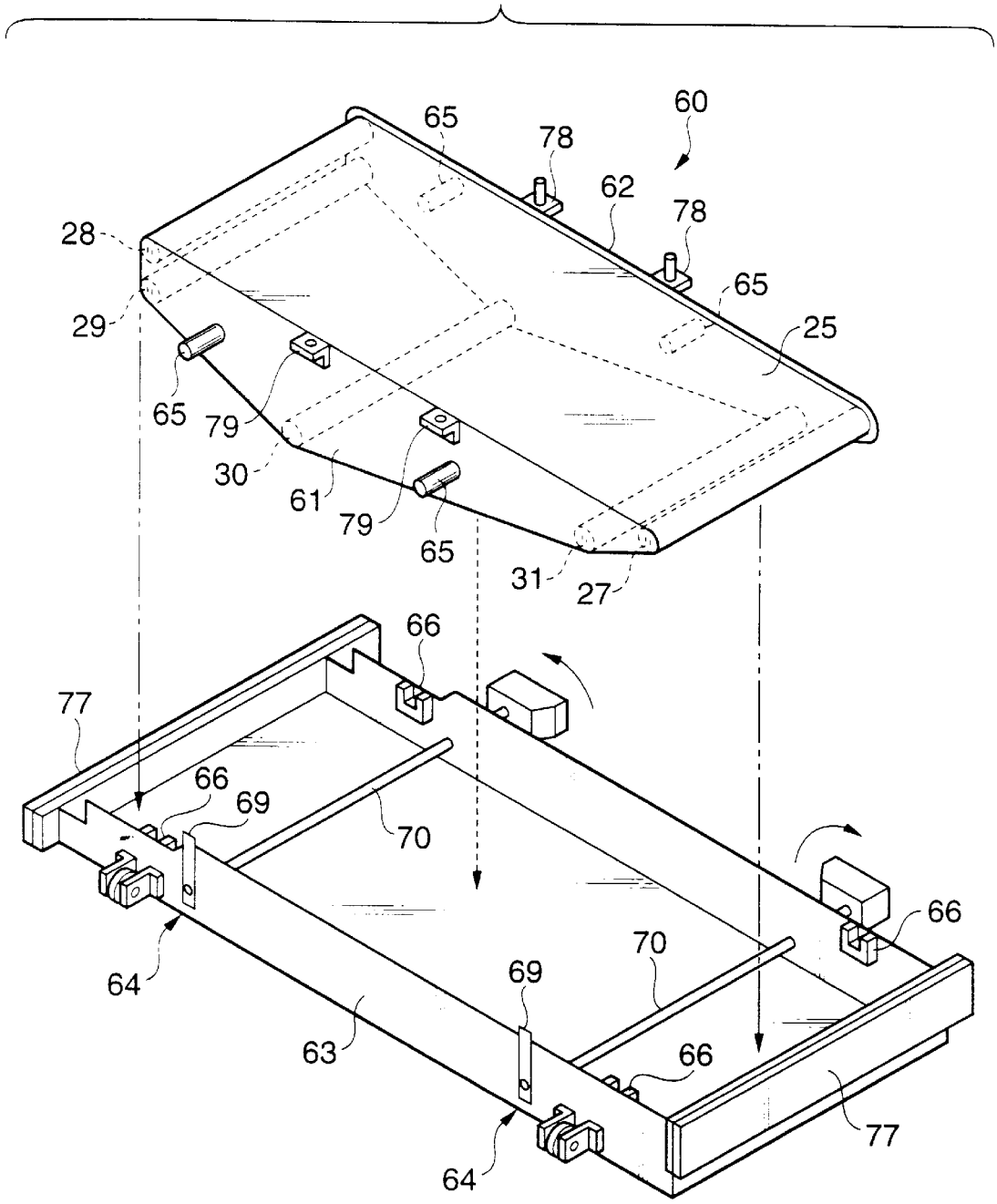
FIG. 6 is an exploded perspective view of a retracting unit for a belt module.

In FIGS. 4 and 5, reference number 60 represents the belt module for supporting the intermediate transfer belt 25 such that it can circulate. As shown in FIG. 6, the belt module 60 has a front-side frame 61 and a rear-side frame 62 to which a driving roll 27 for supporting the intermediate transfer belt 25 such that it can circulate, a driven roll 28, a tension roll 29, a backup roll 30 for secondary transfer and an idle roll 31 are rotatably attached. The belt module 60 is attached to a holding fame 63 in the form of a rectangular frame body, for holding the belt module 60 such that it can be elevated and such that it can be pulled out from the image recorder main unit 1.

Figure 7:
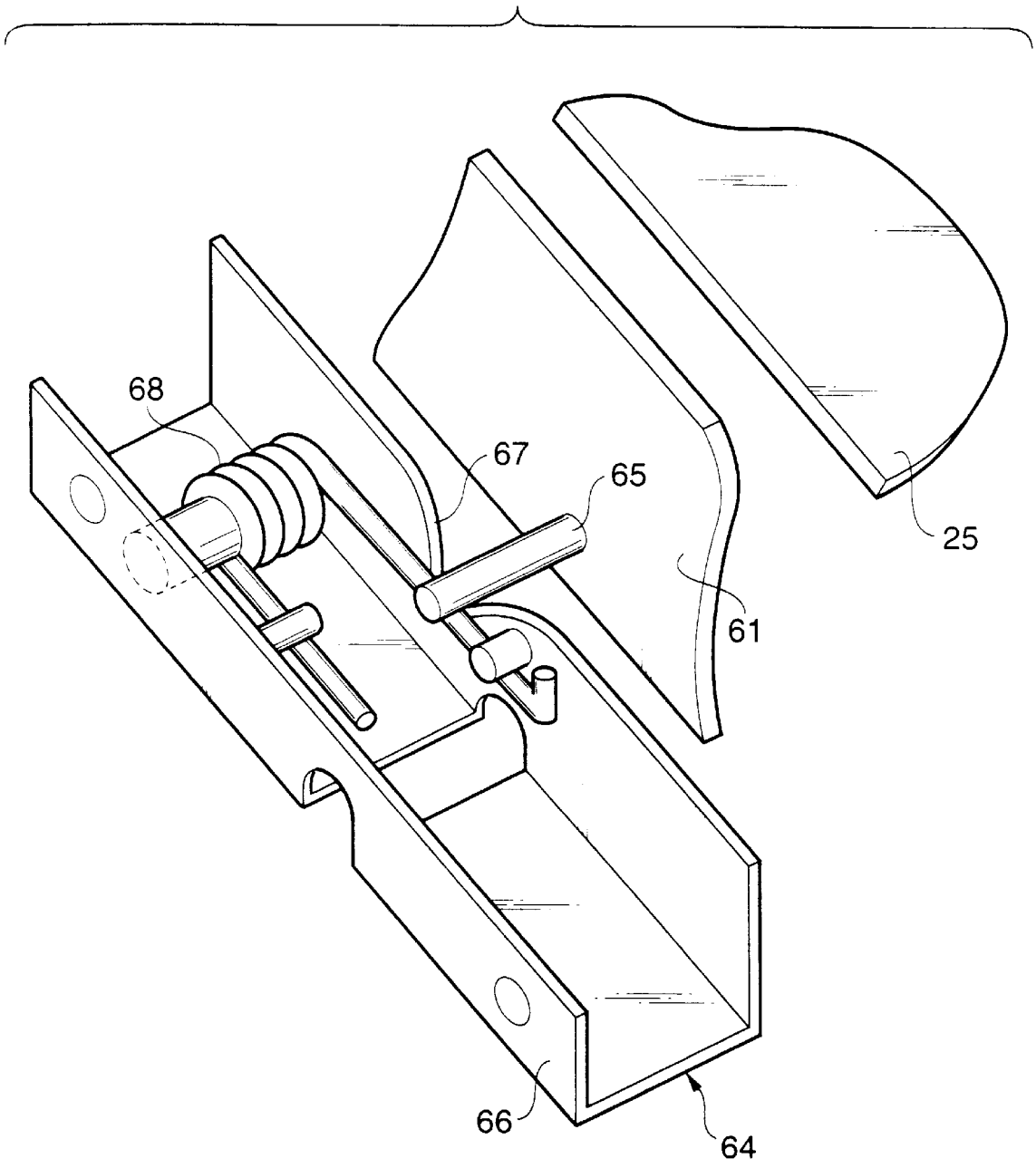
FIG. 7 is a perspective view of major parts of the retracting unit for the belt module.
Figure 8A:
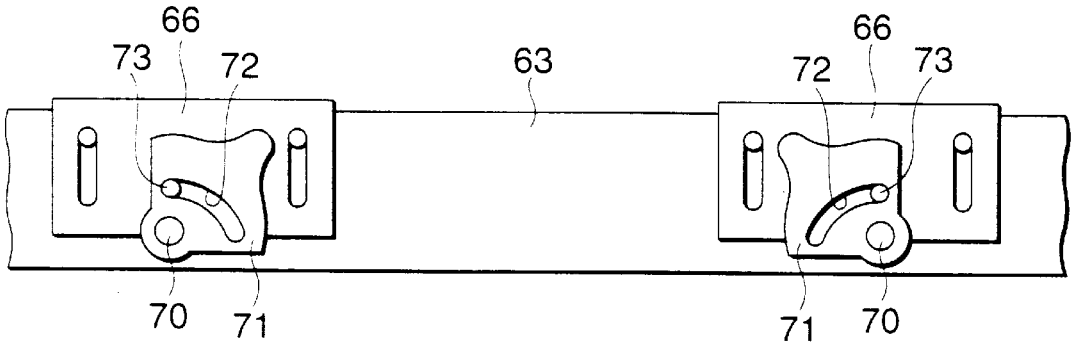
FIGS. 8A and 8B are front views of major parts of the retracting unit for the belt module.
Figure 8B:
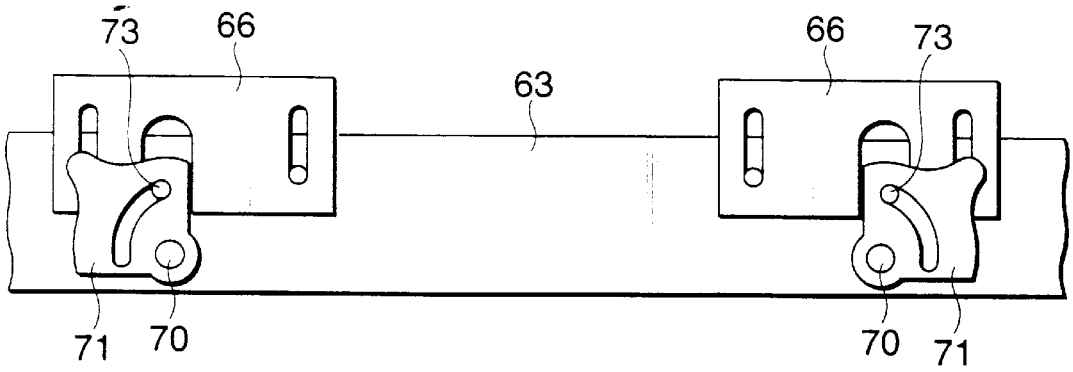

A first retracting unit 64 is provided on the belt module 60 and holding frame 63 for moving the belt module 60 up and down to retract the same such that the intermediate transfer belt 25 is spaced from all of the photosensitive drums 12Y, 12M, 12C and 12K. The retracting unit 64 has four elevating rods 65 in total two each of which are respectively attached to the exterior of the front frame 61 and rear frame 62 of the belt module 60 at a predetermined interval in the horizontal direction. As shown in FIG. 7, the four elevating rods 65 are elastically supported in recesses 67 provided on elevating members 66 through elastic members 68 constituted by coil springs or the like. As shown in FIGS. 8A and 8B, the elevating members 66 are elevatably attached to the holding frame 63 in positions of the belt module 60 associated with the elevating rods 65. As shown in FIGS. 4 and 5, the elevating members 66 are configured such that they are moved upward or downward as described below by first handles 69 as first handle members provided on the front side of the holding frame 63.

Figure 9:
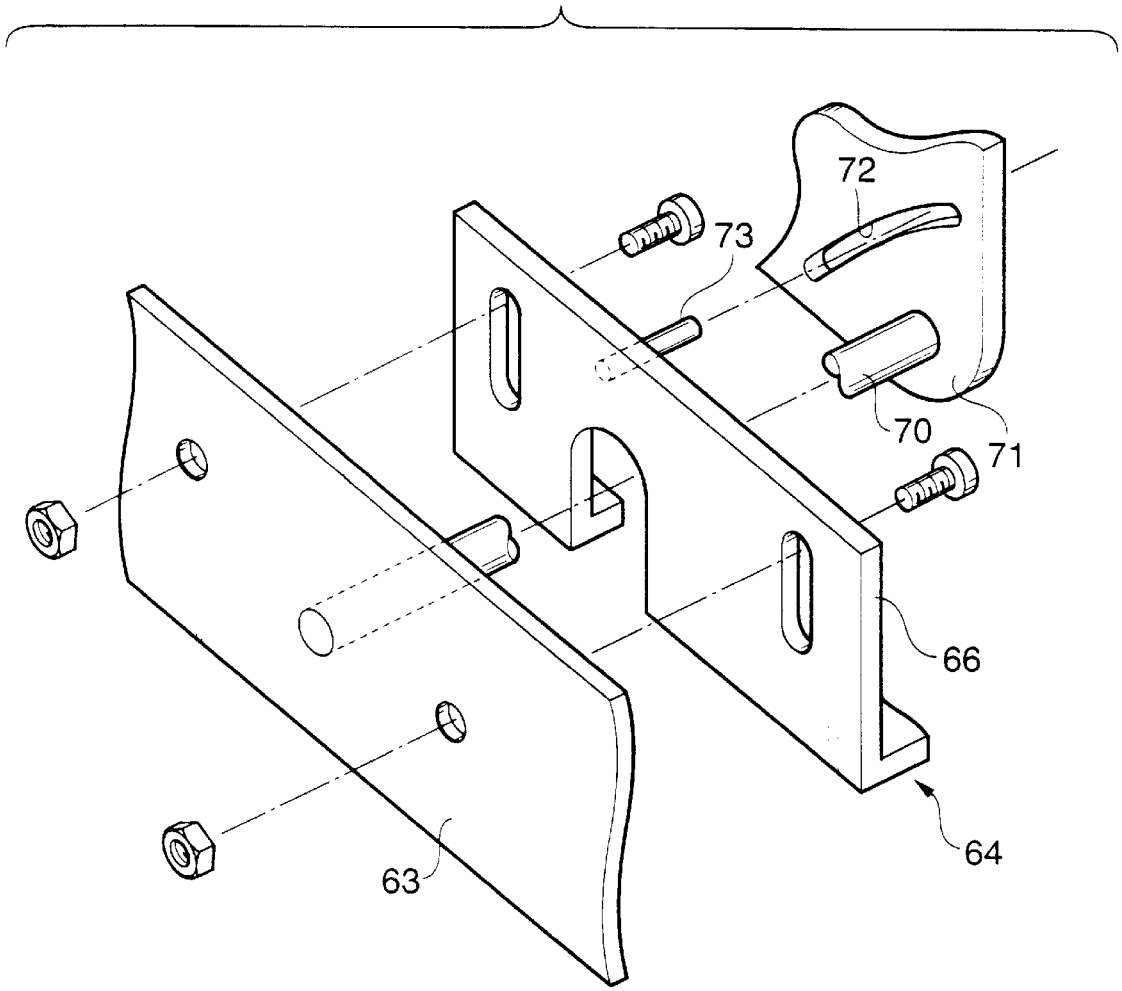
FIG. 9 is a perspective view of major parts of the retracting unit for the belt module.

As shown in FIG. 6, rotary shafts 70 rotatably provided on both of the left and right sides of the holding frame 63 are attached to the first handles 69 As shown in FIGS. 8A, 8B and 9, eccentric cams 71 for moving the elevating members 66 upward or downward are fixed on both ends of the rotary shafts 70 in the axial direction thereof. The eccentric cams 71 are formed with grooves 72 having a radius which gradually increases, and shaft members 73 for elevation secured to the elevating members 66 are fitted into the grooves 72.

As shown in FIGS. 4, 5 and 6, with the first retracting unit 64, the rotary shafts 70 to which the first handles 69 are attached are rotated by rotating the first handles 69 attached to the holding frame 63 in the directions indicated by the arrows. Then, as shown in FIG. 8A, the eccentric cams 71 secured to the rotary shafts 70 rotate as a result of the rotation of the rotary shafts 70 to move the elevating members 66 downward through the shaft members 73 for elevation fitted into the grooves 72 on the eccentric cams 71. The belt module 60 elastically held at the elevating members 66 through the coil springs 68 moves downward along with the elevating members 66 and, as shown in FIG. 10, the belt module 60 is retracted such that the intermediate transfer belt 25 supported by the belt module 60 is retracted from all of the photosensitive drums 12Y, 12M, 12C and 12K.

As shown in FIGS. 4, 5 and 6, with the first elevating unit 64, the rotary shafts 70 to which the first handles 69 are attached are rotated by rotating the first handles 69 attached to the holding frame 63 in the opposite directions. Then, as shown in FIG. 8B, the eccentric cams 71 secured to the rotary shafts 70 rotate as a result of the rotation of the rotary shafts 70 to move the elevating members 66 upward through the shaft members 73 for elevation fitted into the grooves 72 on the eccentric cams 71. The belt module 60 elastically held at the elevating members 66 through the coil springs 68 moves upward along with the elevating members 66 and, as shown in FIG. 11, the belt module 60 is set such that the intermediate transfer belt 25 supported by the belt module 60 is put into contact with all of the photosensitive drums 12Y, 12M, 12C and 12K.

Figure 10:
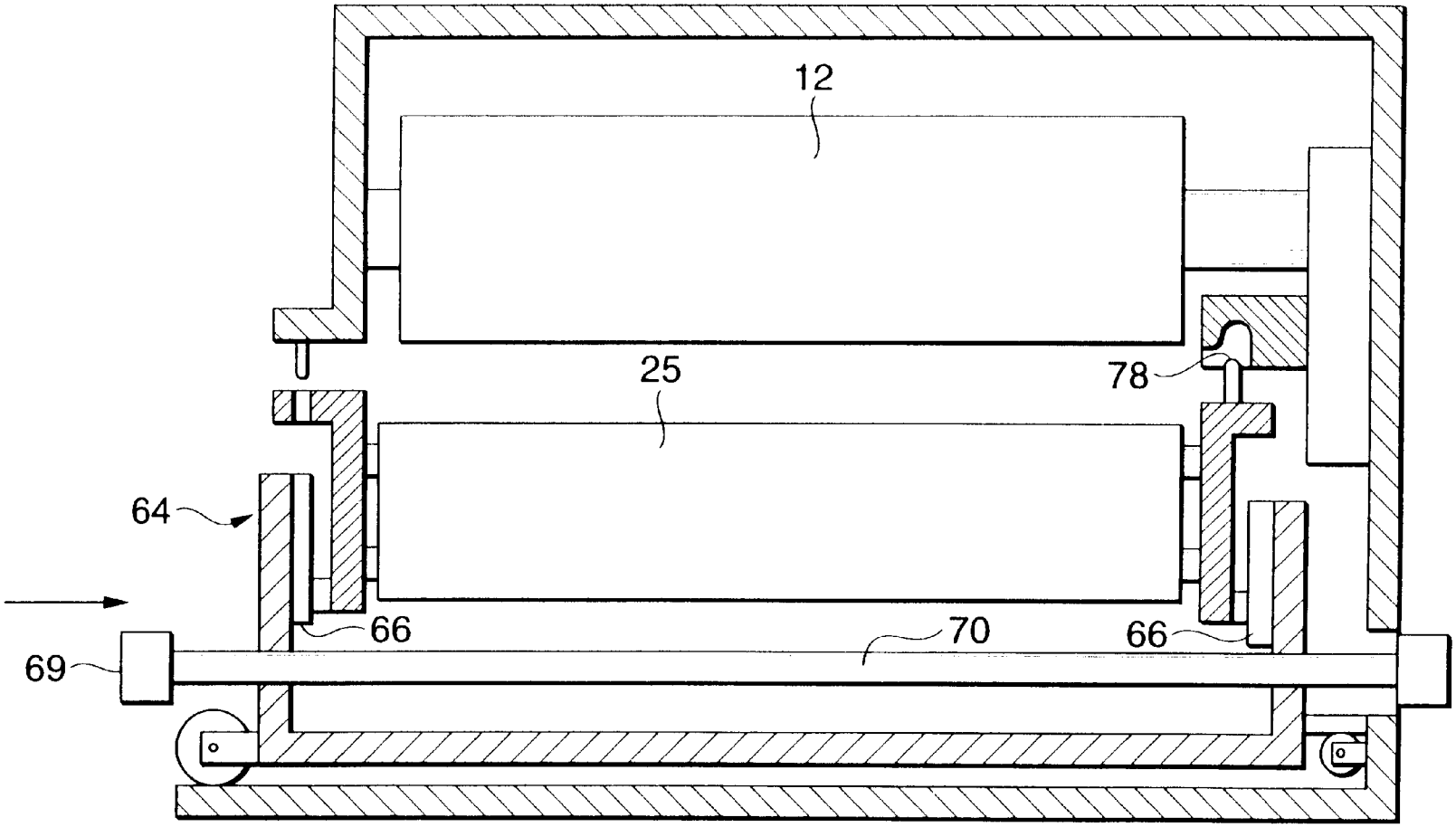
FIG. 10 is a sectional view of major parts of the retracting unit for the belt module.
Figure 11:
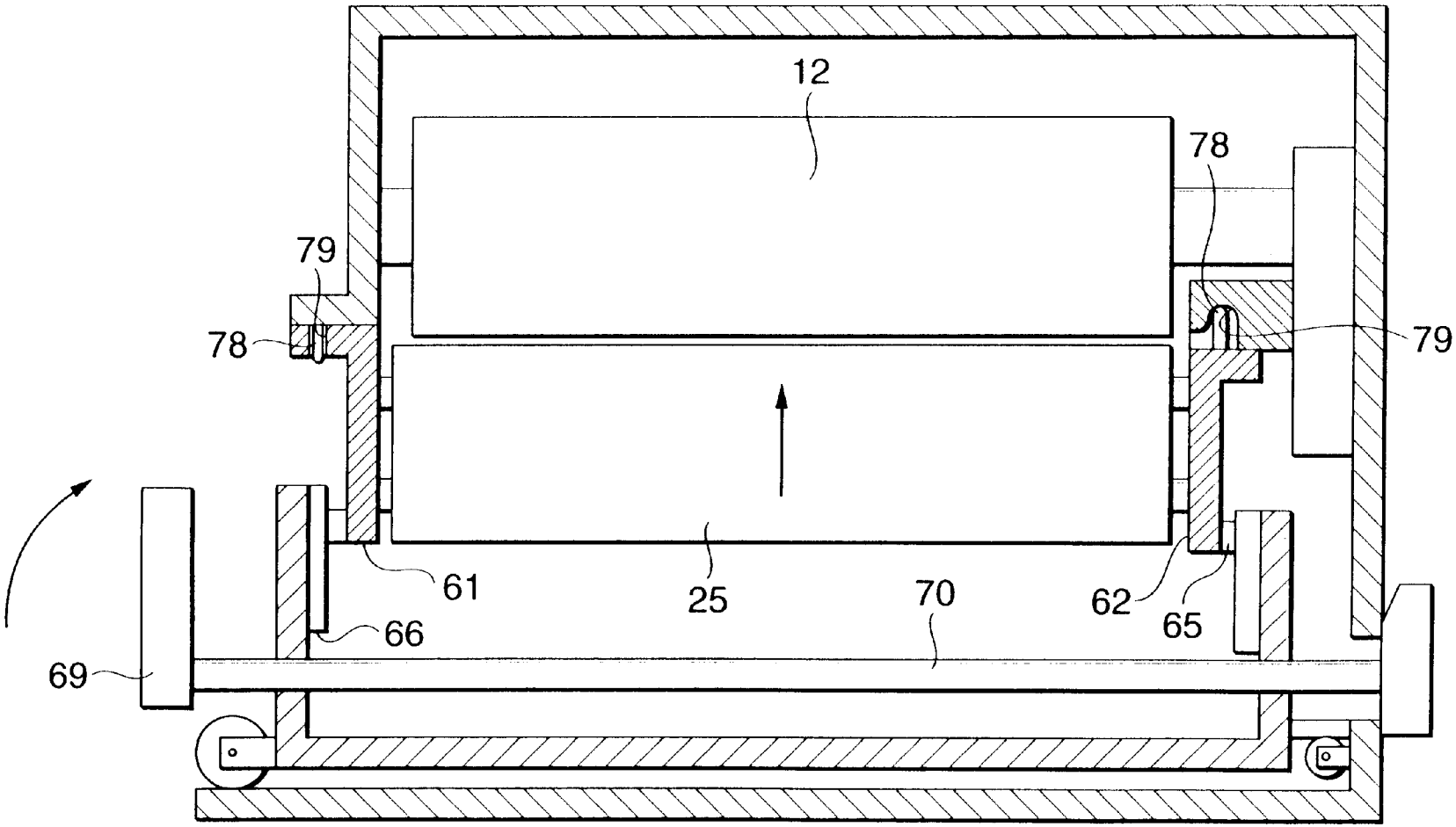
FIG. 11 is a sectional view of major parts of the retracting unit for the belt module.

Reference numbers 78 and 79 in FIGS. 10 and 11 respectively represent a projection and a recess for positioning the belt module 60 in a predetermined position when the belt module 60 is elevated.

As shown in FIGS. 4 and 5, auxiliary handles 75 are coupled to the first handles 69 through links 74 to provide a configuration in which the auxiliary handles 75 are rotated in the same direction as that of the first handles 69 when the first handles 69 are rotated. The first handles 69 and auxiliary handles 75 abut against the ends of the photosensitive drums 12Y, 12M, 12C and 12K when the photosensitive drums 12Y, 12M, 12C and 12K are moved toward this side in the axial direction thereof to prevent photosensitive drums 12Y, 12M, 12C and 12K from being removed inadvertently. The first handles 69 and auxiliary handles 75 are configured such that they are moved to positions where the photosensitive drums 12Y, 12M, 12C and 12K can be removed by rotating them to lower the belt module 60.

As shown in FIGS. 5 and 6, the holding frame 63 to which the belt module 60 is attached can be pulled out from the image recorder main unit 1 using slide rails 77 as a first pull-out unit provided on both ends thereof.

This embodiment of the invention has a configuration including a secondary transfer module which supports the secondary transfer roll in contact with the opposite roll supporting the belt-shaped intermediate transfer body, a second retracting unit which retracts the secondary transfer module such that the secondary transfer roll is retracted from the opposite roll and a second pullout unit which pulls out the secondary transfer module from the image recorder main unit.

Figure 12:
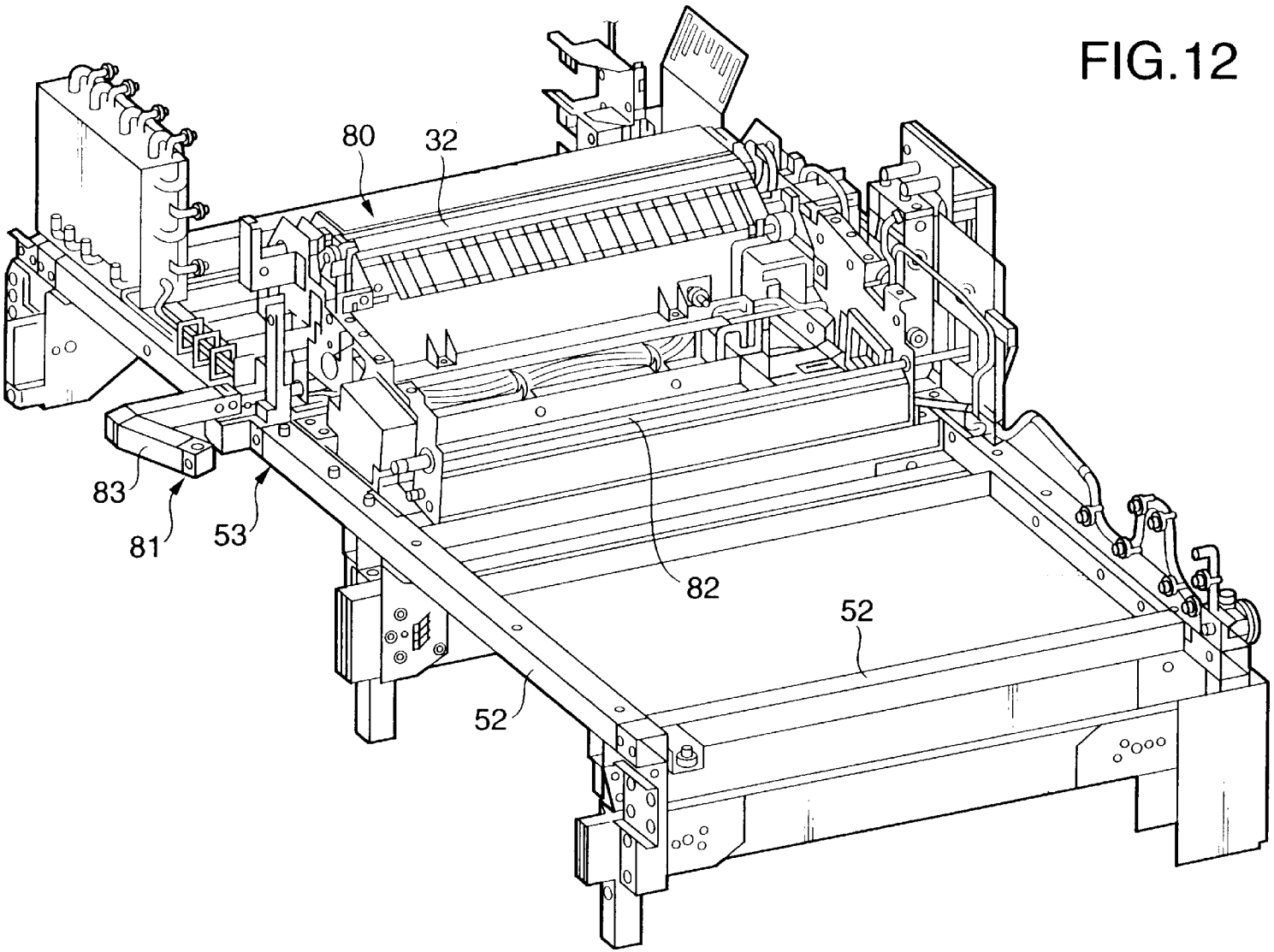
FIG. 12 is a perspective view of a retracting unit for a secondary transfer module.

Specifically, as shown in FIG. 12, the embodiment has a secondary transfer module 80 which supports the secondary transfer roll 32 in contact with the backup roll 30 supporting the intermediate transfer belt 25, and the secondary transfer module 80 can be retracted by a second retracting unit 81 such that the secondary transfer roll 32 is spaced from the backup roll 30. As shown in FIG. 12, the secondary transfer module 80 is attached to a slide structure 53 slidably attached to the image recorder main unit 1 such that it can rotate about a rotary shaft 82.

Figure 13:
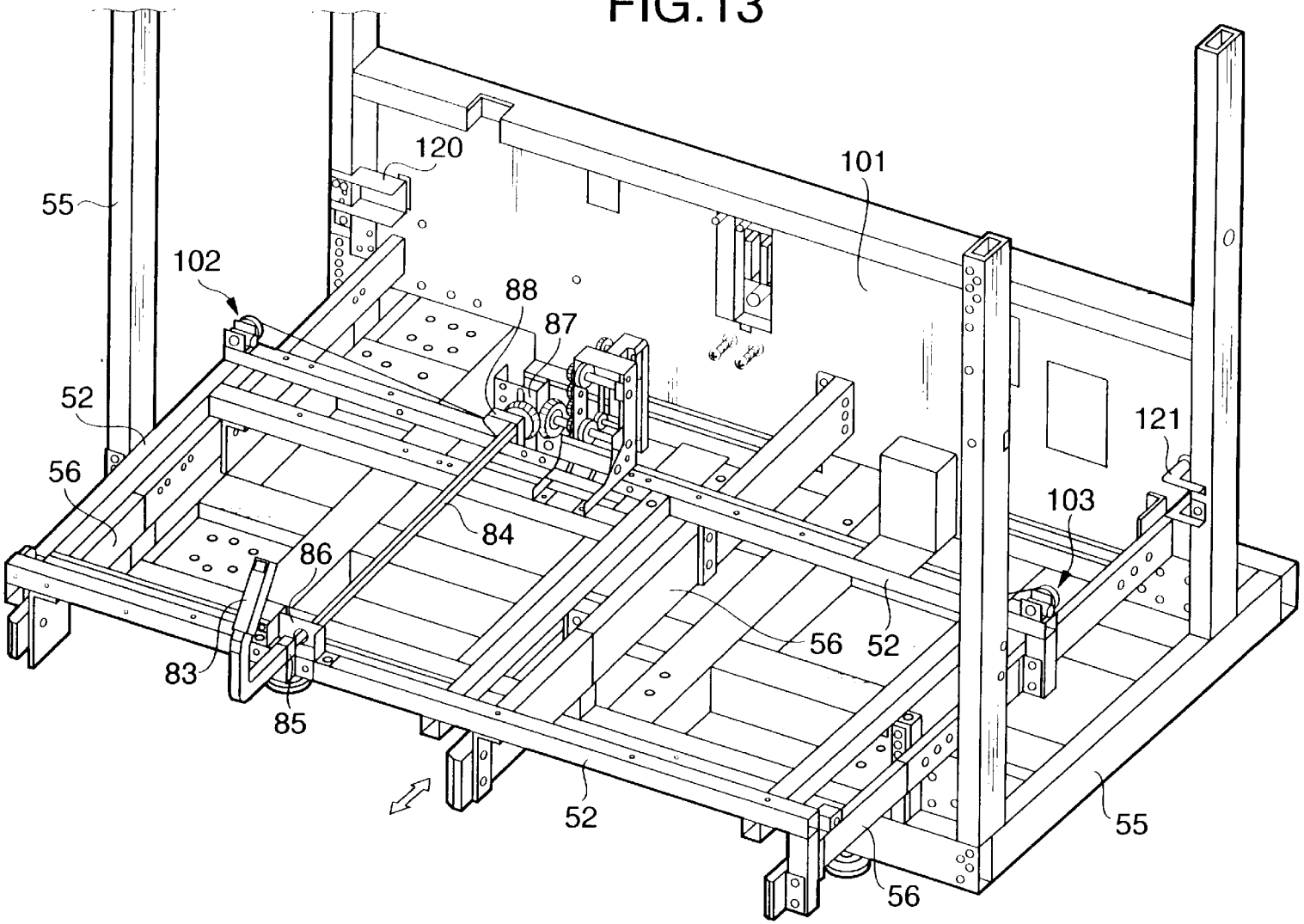
FIG. 13 is a perspective view of the retracting unit for the secondary transfer module.

As shown in FIG. 13, the slide structure 53 has a bottom frame 52 to which the secondary transfer module 80, the paper transporting roller pairs and the paper-absorbing transport belts 34 and 35 as paper transport members, the fixing device 36 and the paper-inverting transport member 47 are attached. The bottom frame 52 is attached to a frame 55 of the image recorder main unit 1 such that it can slide horizontally at the front side of the image recorder main unit 1 on three rails 56 as the second pull-out unit disposed horizontally.

As shown in FIG. 13, a second handle 83 which is a handle member of the second retracting unit 81 is rotatably provided on the front side of the bottom frame 52 of the slide structure 53 in a position shifted toward the left side thereof from the center to retract the secondary transfer module 80 such that the secondary transfer roll 32 is spaced from the backup roll 30. The second handle 83 also allows operations such as pulling out the slide structure 53 and pushing it into a predetermined position. The second handle 83 is coupled to a handle shaft 84 extending between the front and further sides of the bottom frame 52 through a link member 85. The handle shaft 84 to which the second handle 83 is coupled is rotatably attached to the bottom frame 52 through bearing plates 86 and 87 erected on the front and further ends of the bottom frame 52, respectively. As shown in FIG. 13, an arm 88 for moving the secondary transfer module 80 upward or downward is secured to the further end of the handle shaft 84. The arm 88 is operated for rotation along with the second handle 83 through the handle shaft 84 and is normally stopped with the second handle 83 rotated at 90 degrees clockwise in which state the arm 88 moves the secondary transfer module 80 upward to urge the secondary transfer roll 32 supported by the secondary transfer module 80 against the backup roll 30. When the secondary transfer roll 32 is to be spaced from the backup roll 30, as shown in FIG. 13, the second handle 83 is erected by stopping it after rotating it 90 degrees counterclockwise to allow the arm 88 to lower the secondary transfer module 80.

Furthermore, the embodiment has a configuration in which the first retracting unit retracts the belt module such that the belt-shaped intermediate body is spaced from all of the image carrying bodies after the secondary transfer module is retracted by the second retracting unit such that it is spaced from the backup roll.

Further, the embodiment has a configuration including an erroneous operation preventing unit for preventing the operation of the first retracting unit to retract the belt module such that the belt-shaped intermediate transfer body is spaced from all of the image carrying bodies before the secondary transfer module is retracted by the second transfer roll such that it is spaced from the backup roll.

Figure 14:
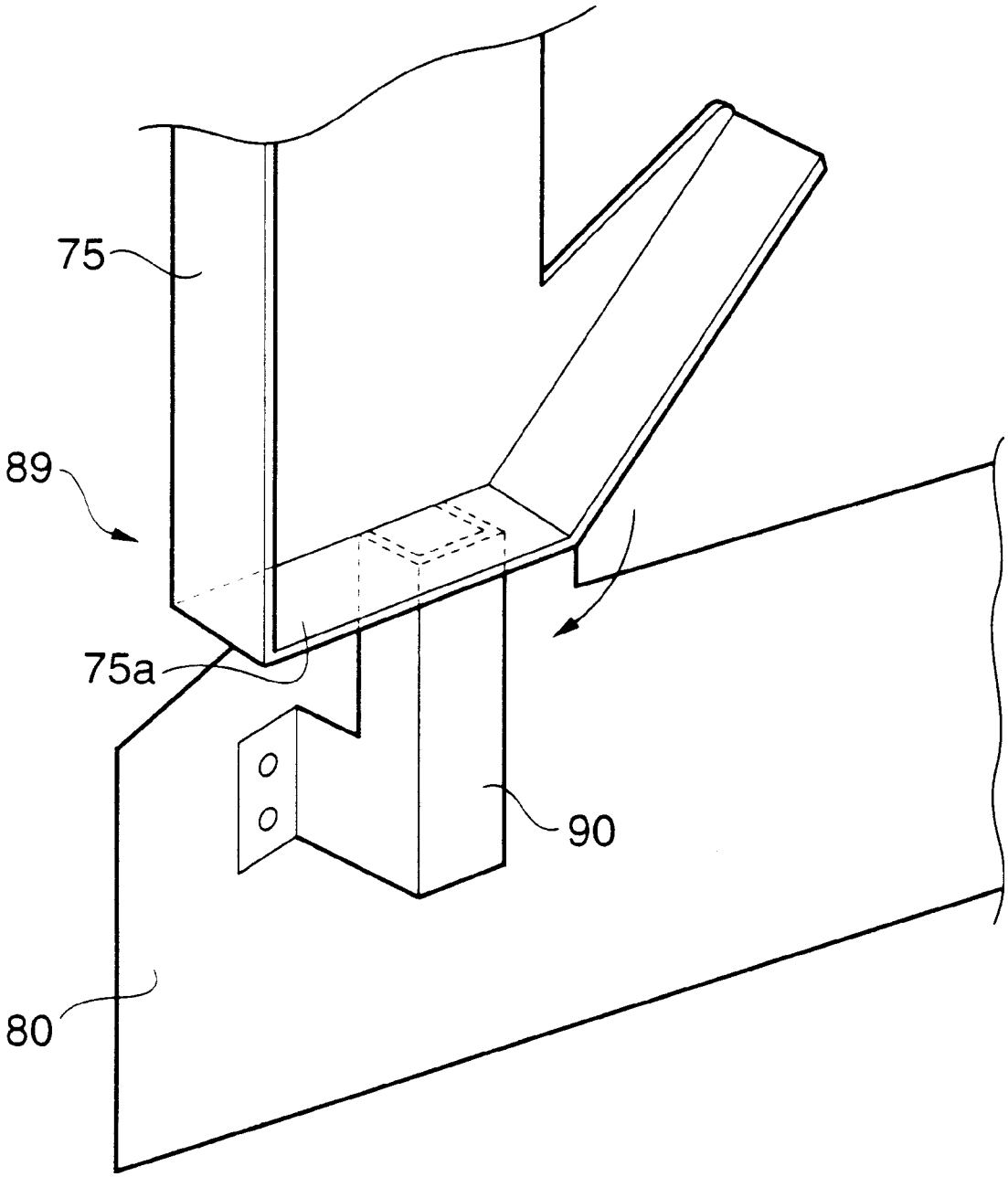
FIG. 14 is a perspective view of an erroneous operation preventing unit for the secondary transfer module.

Specifically, as shown in FIGS. 4, 5 and 14, an abutting member 90 as an erroneous operation preventing unit 89 is attached to the upper left end of the front side of the secondary transfer module 80. Lower ends 75*a* of the auxiliary handles 75 of the first retracting unit 64 that form a part of the erroneous operation preventing unit 89 abut the abutting member 90 of the secondary transfer module 80.

With the erroneous operation preventing unit 89, when the operation of the first retracting unit 64 to retract the belt module 80 such that the intermediate transfer belt 25 is spaced from all of the photosensitive drums 12 is attempted before the secondary transfer module 80 is retracted such that the secondary transfer roll 32 is spaced from the backup roll 30, the lower ends 75a of the auxiliary handles 75 of the first retracting unit 64 abut against the abutting members 90 of the secondary transfer module 80. Therefore, the operation of the first retracting unit 64 to retract the belt module 80 such that the intermediate transfer belt 25 is spaced from all of the photosensitive drums 12 is inhibited before the secondary transfer module 80 is retracted such that the secondary transfer roll 32 is spaced from the backup roll 30.

The rotation of the second handle 83 is normally restricted by a handle stopper 91 as a handle restricting unit for restricting the rotation of the second handle 83. The handle stopper 91 is provided at the further end of the handle shaft 84. While the handle stopper 91 normally restricts the rotation of the second handle 83 to fix the second handle 83 in a non-rotating state, it is configured to enable the rotation of the second handle 83 when the slide structure 53 is pushed into a predetermined position inside the image recorder main unit 1.

Figure 15:
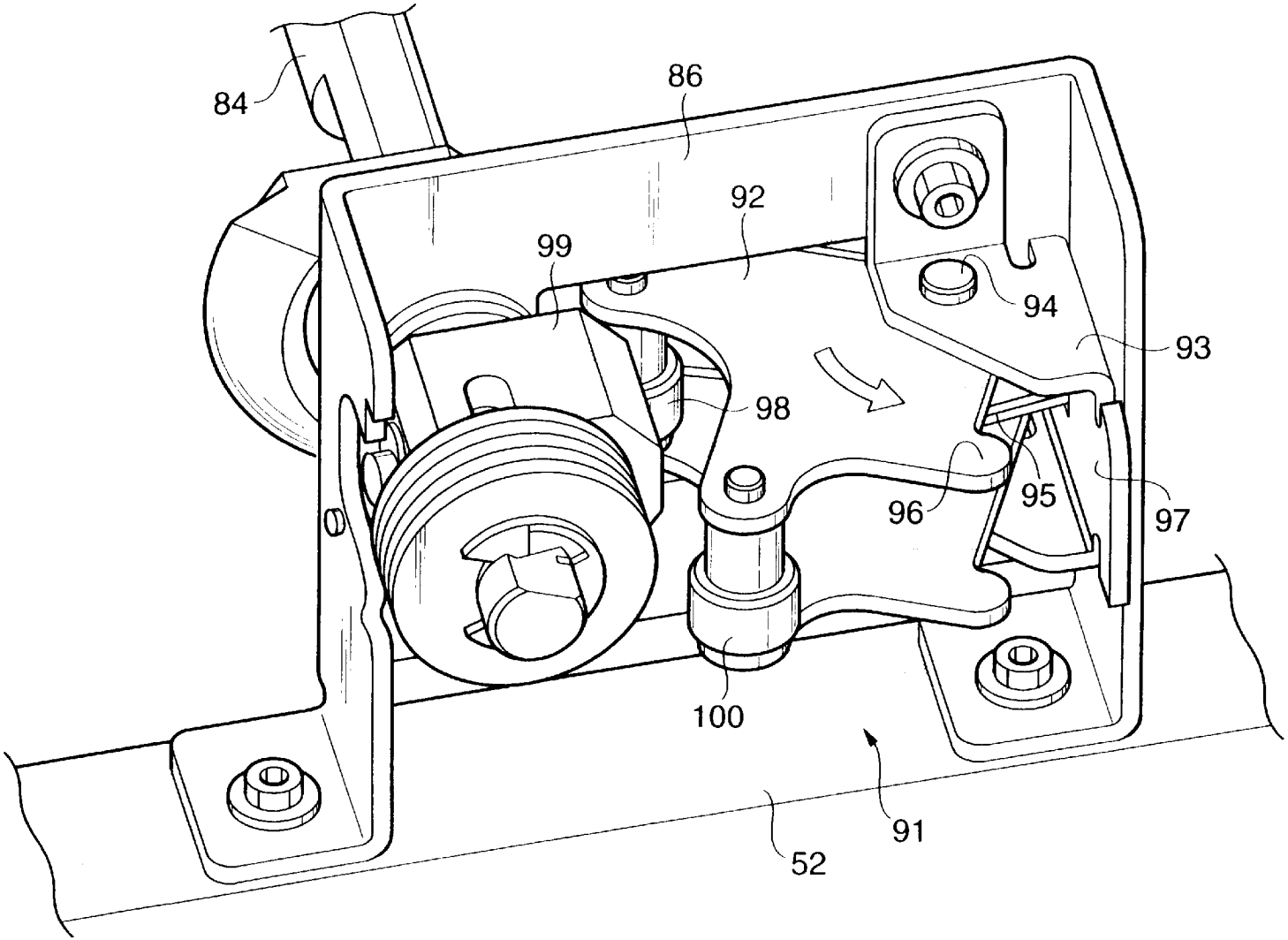
FIG. 15 is a perspective view of a handle stopper.
Figure 16:
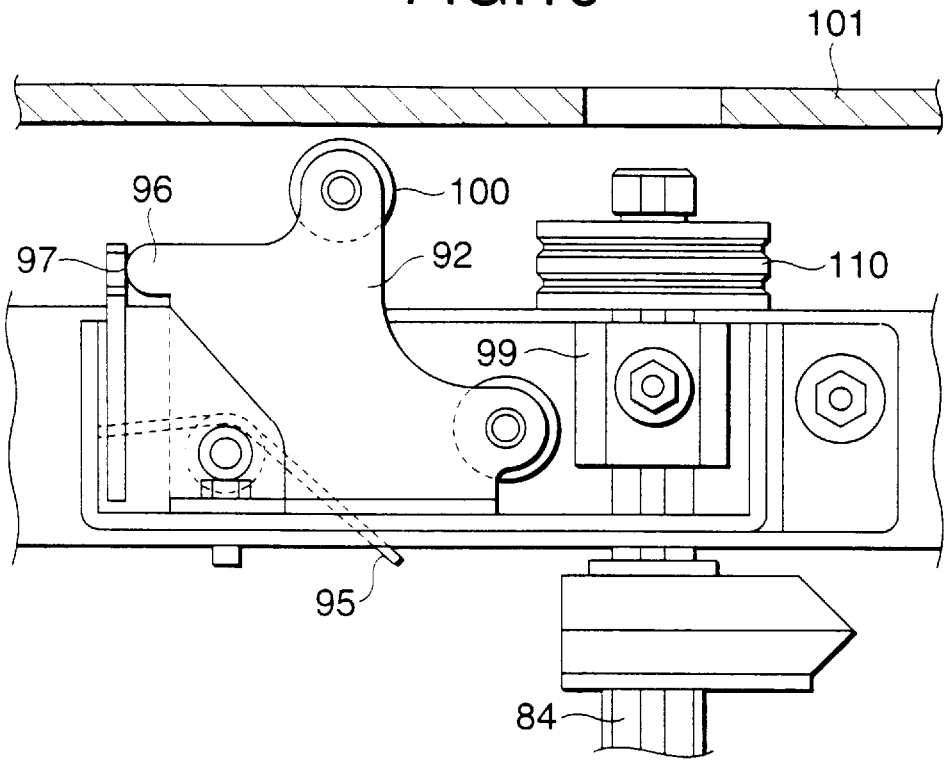
FIG. 16 is a plan view showing an operation of the handle stopper.
Figure 18:
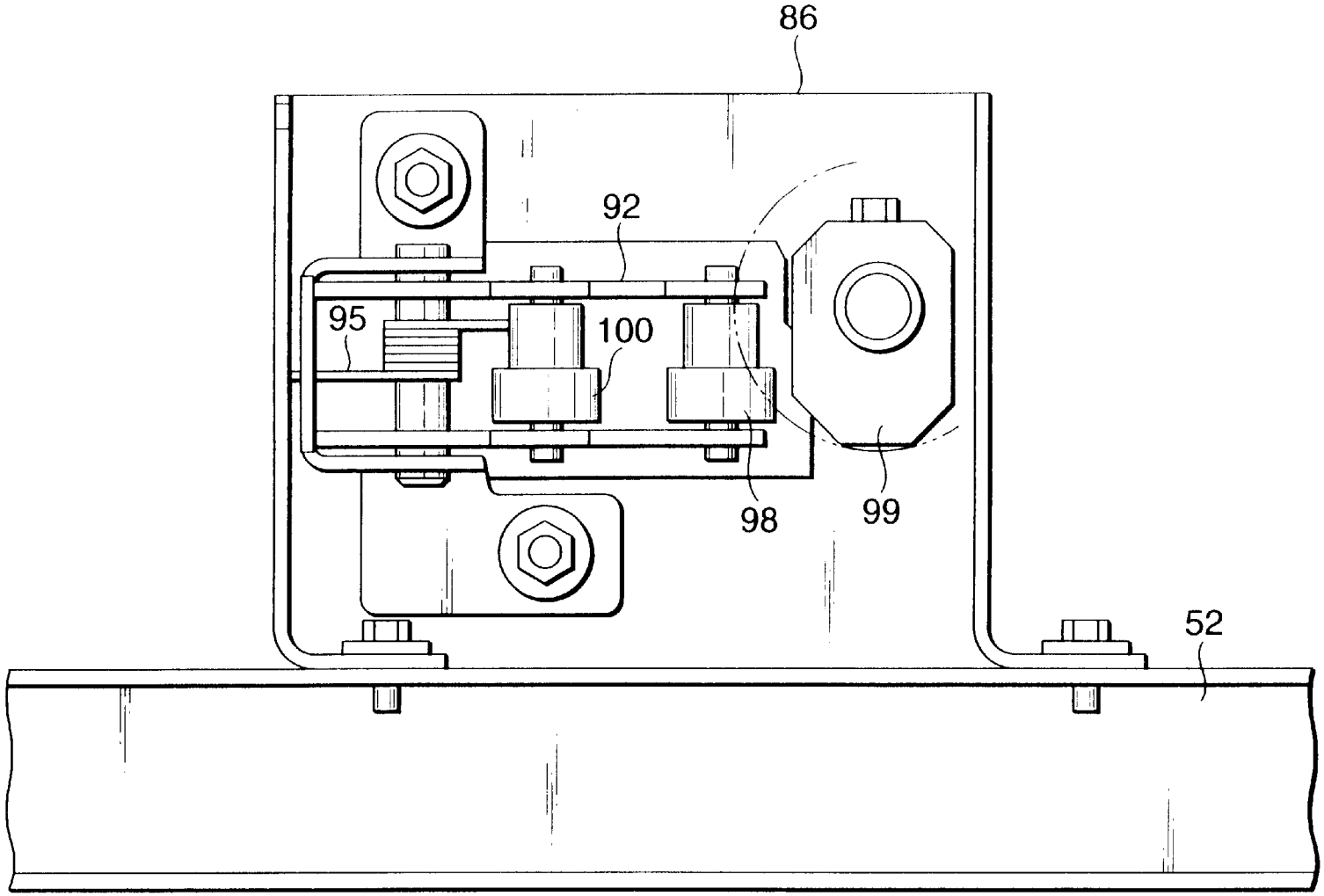
FIG. 18 is a front view showing the operation of the handle stopper.

Specifically, as shown in FIG. 15, the handle stopper 91 has a stopper member 92, and the stopper member 92 is attached to a support plate 93 such that it can rotate in the horizontal direction about a rotary shaft 94. The support plate 93 is attached to the bearing plate 87 provided on the further side of the bottom frame 52. The stopper member 92 is urged by a spring 95 for rotation in the direction indicated by the arrow and is normally stopped in a state in which an abutting portion 96 of the stopper member 92 abuts against an abutting portion 97 of the support plate 93 as shown in FIG. 16. In this state, as shown in FIGS. 16 and 18, a first roller 98 provided on the stopper member 92 to prevent the second handle 83 from rotating abuts against a block 99 securely attached to the further end of the handle shaft 84 to prevent the second handle 83 from rotating. The second handle 83 is set such that the block 99 attached to the handle shaft 84 has a play of about 15 degrees before it abuts against the first roller 98.

Figure 17:
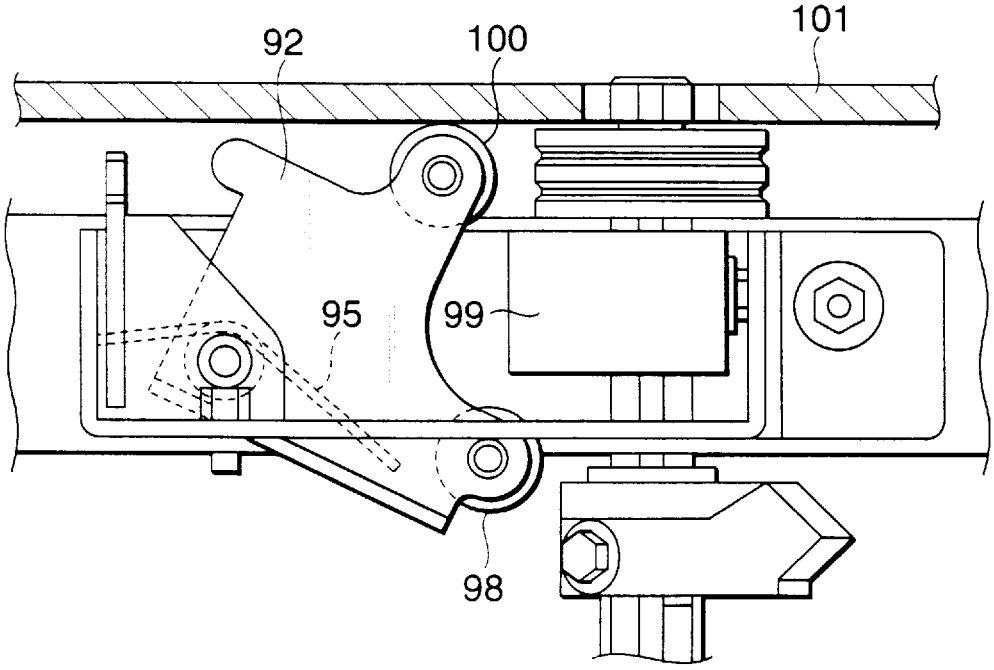
FIG. 17 is a plan view showing the operation of the handle stopper.

When the second handle 83 is operated to push the slide structure 53 into the predetermined position in the image recorder main unit 1, a second roller 100 of the stopper member 92 of the handle stopper 91 rotates in abutment against a frame metal plate 101 on the rear side of the image recorder main unit 1 as shown in FIG. 17 and stops with the stopper member 92 rotated clockwise (in FIG. 17) at a predetermined angle. In this state, as shown in FIG. 17, the first roller 98 for restricting the handle of the stopper member 92 is out of the position to restrict the rotation of the block 99 provided on the handle shaft 84, and the rotation of the second handle 83 is therefore permitted.

While the handle stopper 91 normally restricts the rotation of the second handle 83 to fix the second handle 83 in a non-rotating state as described above, it is configured to enable the operation of the second handle 83 when the slide structure 52 is pushed into the predetermined position in the image recorder main unit 1.

Further, in the embodiment, locking units 102 and 103 are provided on both of the left and right ends on the further side of the bottom frame 52 of the slide structure 53 as shown in FIG. 13 to allow the slide structure 53 to be positioned and secured in a fixed position in the image recorder main unit 1 by rotating the second handle 83 to a first position.

Figure 19A:
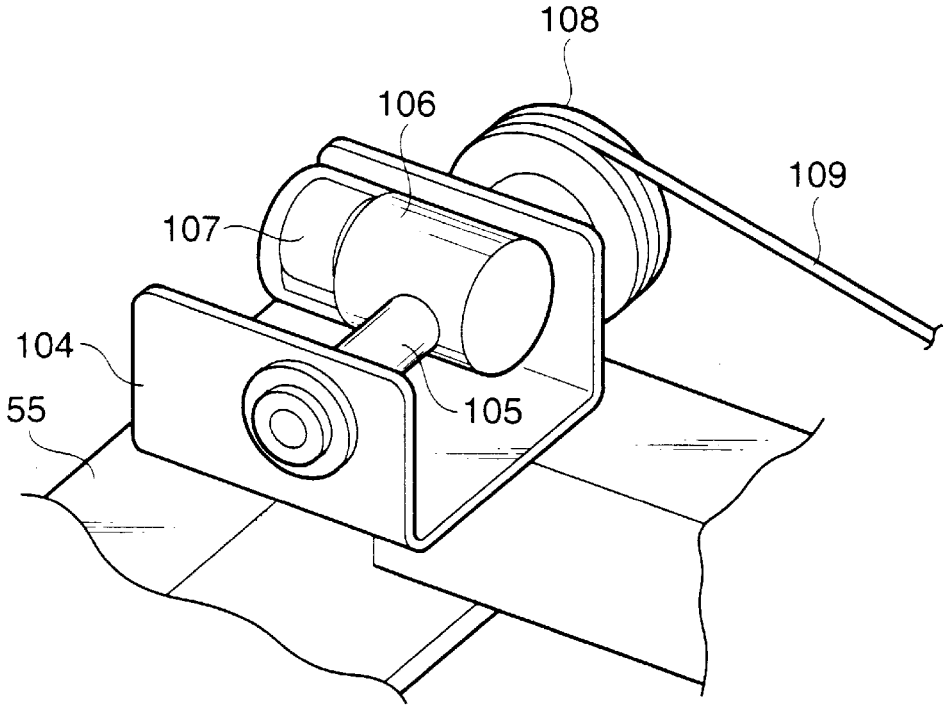
FIGS. 19A and 19B are perspective views of a locking unit.
Figure 19B:
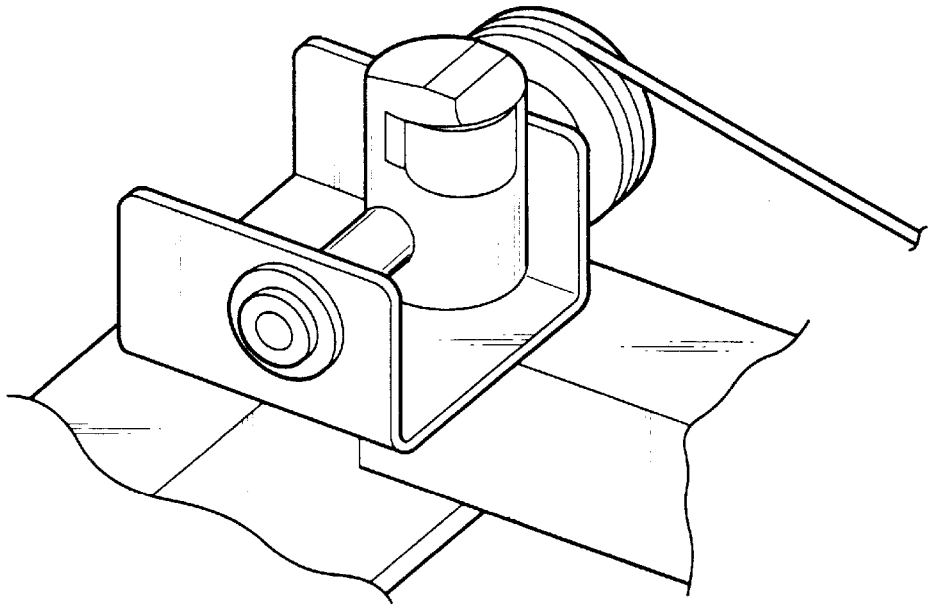
Figure 22:
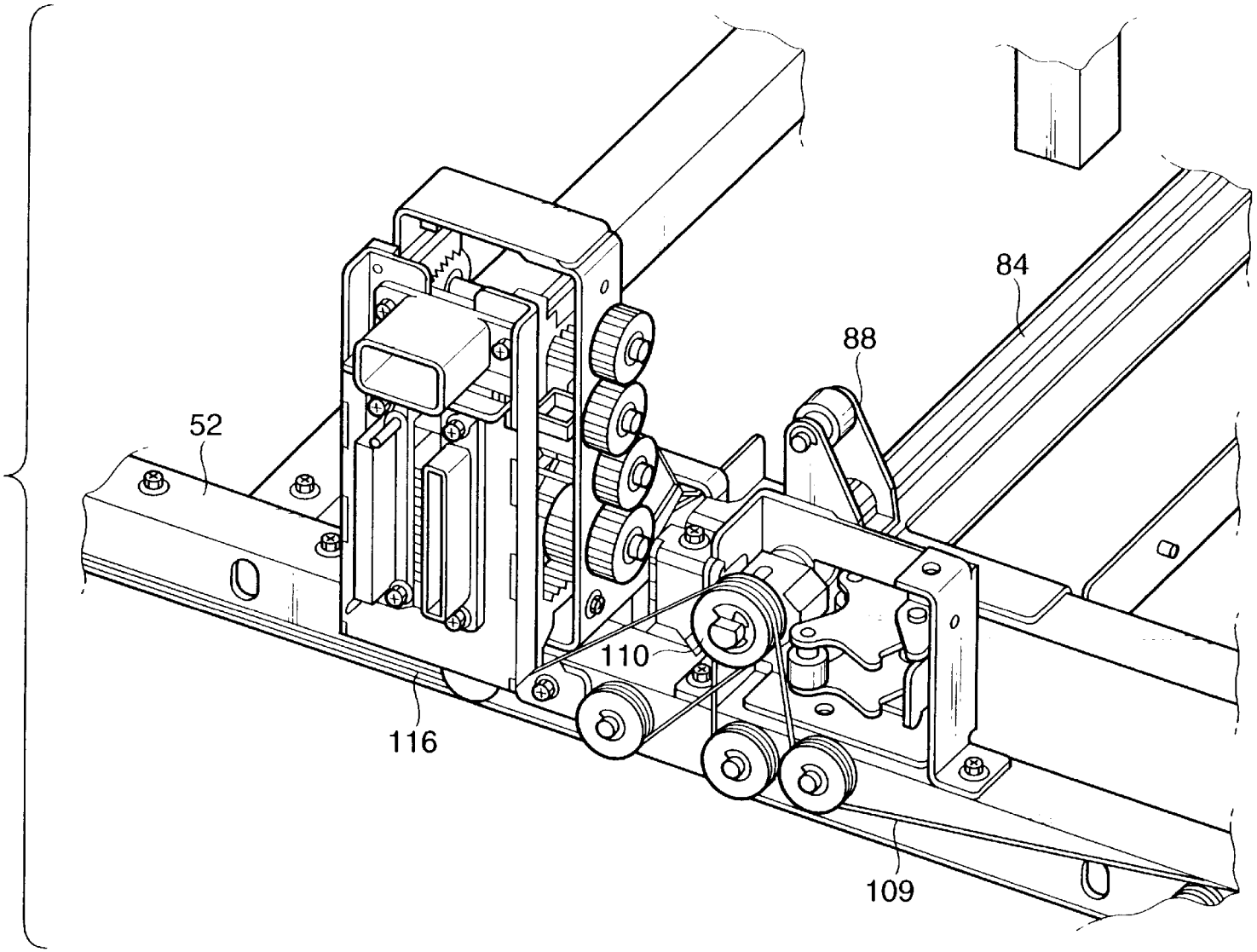
FIG. 22 is a perspective view of the locking unit as viewed from the rear side thereof.

As shown in FIG. 19A, the left-side locking unit 102 among the locking units 102 and 103 has a fixing rod 16 which is attached to a support frame 104 secured to the left end of the further side of the bottom frame 52 such that it can rotate about a rotary shaft 105. A roller 107 is rotatably provided on the fixing rod 106 such that it rotates along a fixing member 120 to be described later provided on the frame 55 of the image recorder main unit 1. A pulley 108 for rotating the fixing rod 106 is attached to one end of the rotary shaft 105, and the pulley 108 is coupled to a driving pulley 110 securely attached to the further end of the handle shaft 84 through a wire 109, as shown in FIGS. 19A, 19B and 22. In this embodiment, since the pulley 110 is configured such that it rotates only at about 90 degrees, the wire 109 rotating the pulley 108 is secured to the pulley 108.

Figure 20A:
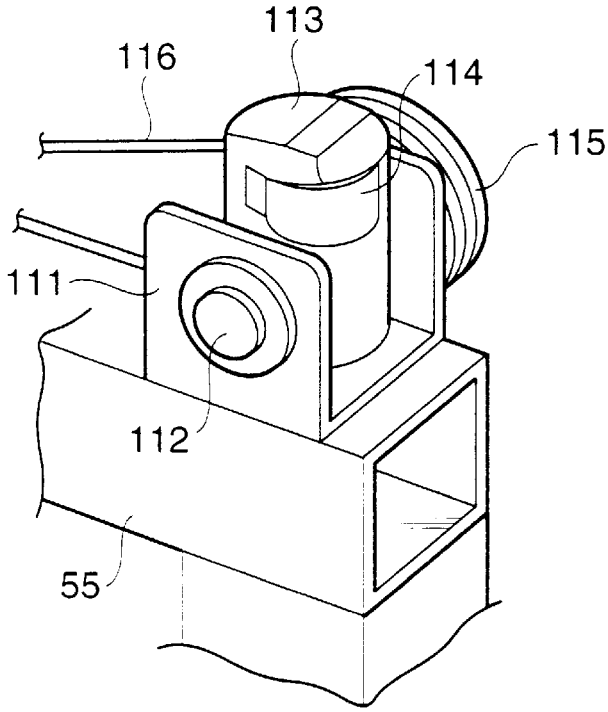
FIGS. 20A and 20B perspective views of the locking unit.
Figure 20B:
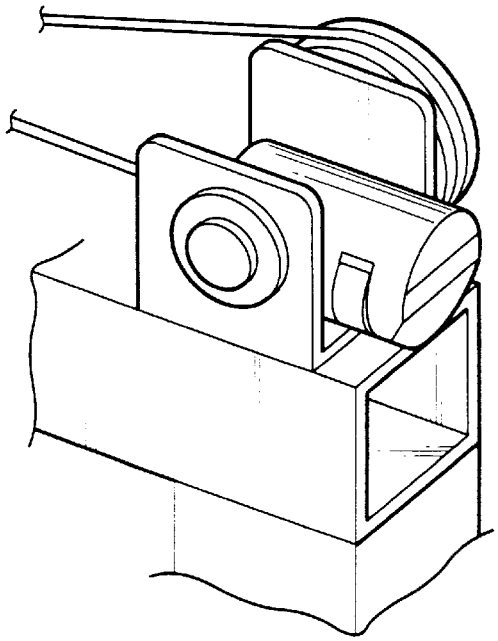

As shown in FIG. 20A, the right-side locking unit 103 among the locking units 102 and 103 has a fixing rod 113 which is attached to a support frame 111 secured to the right end of the further side of the bottom frame 52 such that it can rotate about a rotary shaft 112. A roller 114 is rotatably provided on the fixing rod 113 such that it rotates along a fixing member 121 to be described later provided on the frame 55 of the image recorder main unit 1. A pulley 115 for rotating the fixing rod 113 is attached to one end of the rotary shaft 112, and the pulley 115 is coupled to the driving pulley 110 securely attached to the further end of the handle shaft 84 through a wire 116, as shown in FIGS. 20A, 20B and 22. Since the pulley 115 is also configured such that it rotates only at about 90 degrees like the above-described pulley 108, the wire 116 rotating the pulley 115 is secured to the pulley 115.

Figure 21A:
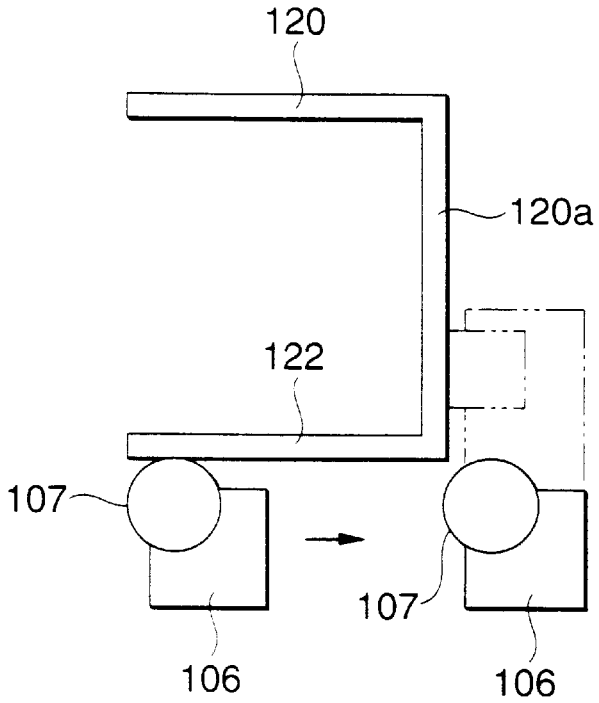
FIGS. 21A and 21B illustrate an operation of the locking unit.
Figure 21B:
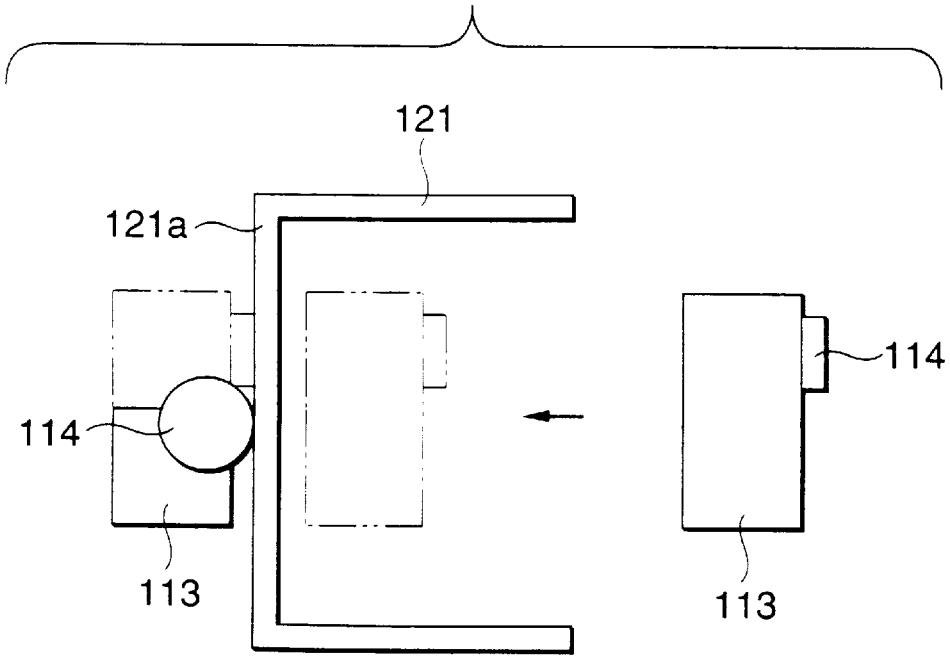

With the left and right locking units 102 and 103, the driving pulley 110 attached to the second handle 83 through the handle shaft 84 is rotated by rotating the second handle 83 from an erected state clockwise to a predetermined position which is a first position. Then, as shown in FIGS. 19B and 21A, the left-side fixing rod 106 among the fixing rods 106 and 113 coupled to the driving pulley 110 through the wires 109 and 116 and the pulleys 108 and 115 rotates clockwise to enter an erected state and abuts against a rear surface 120*a* of a fixing member 120 attached to the frame 55 of the image recorder main unit 1 as shown in FIG. 13 to position and secure the image recorder main unit 1 in a predetermined fixed position. As shown in FIGS. 20B and 21B, the right-side fixing rod 113 rotates clockwise to enter a horizontally oriented state and abuts against a rear surface 121*a* of a fixing member 121 attached to the frame 55 of the image recorder main unit 1 as shown in FIG. 13 to position and secure the image recorder main unit 1 in a predetermined fixed position.

As shown in FIG. 21A, the fixing rod 106 of the left-side locking unit 102 among the locking units 102 and 103 provided on the slide structure 53 side is configured such that it is guided by a handle restricting guide portion 122 formed by horizontally bending the lower end of the fixing member 120 toward the front side before it is anchored on the side of the rear surface 120*a* of the fixing member 120 on the image recorder main unit 1. Therefore, when the second handle 83 is operated to push the slide structure 53 close to the predetermined position in the image recorder main unit 1, since the fixing rod 106 provided on the slide structure 53 abuts against the handle restricting guide portion 122 of the fixing member 120 provided on the image recorder main unit 1, the fixing rod 106 can not rotate any more even if the handle stopper 91 is released in this state, which consequently restricts the rotation of the second handle 83. At this time, the fixing rods 106 and 113 can smoothly move along the handle restricting guide portion 122, and the rollers 107 and 114 are rotatably provided on the fixing rods 106 and 113 as described above to allow them to rotate smoothly along the rear surfaces 120*a* and 121*a* of the fixing members 120 and 121.

Further, the embodiment has a configuration in which the handle member can be folded only after the locking unit is locked using the second handle member.

Figure 23A:
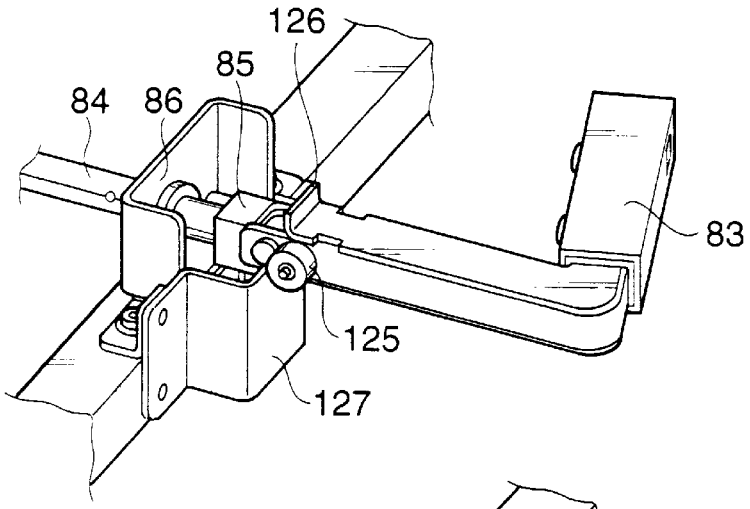
FIGS. 23A, 23B and 23C are perspective views of a handle folding mechanism.
Figure 23B:
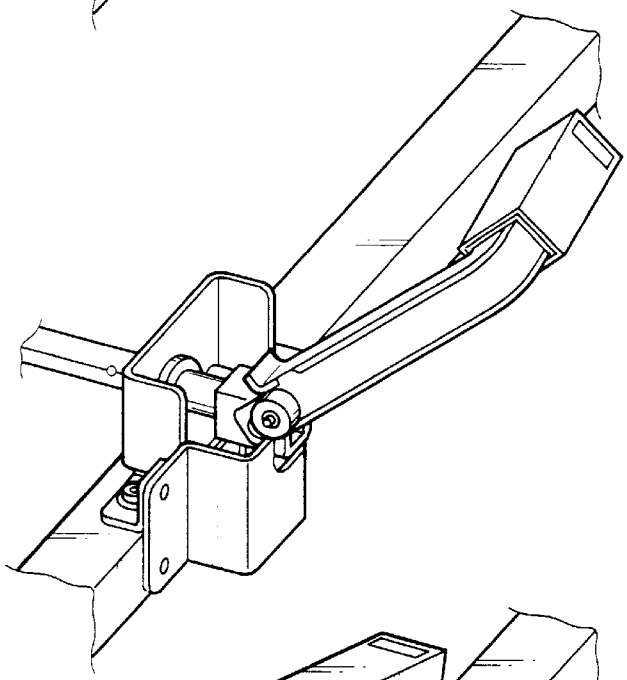
Figure 23C:
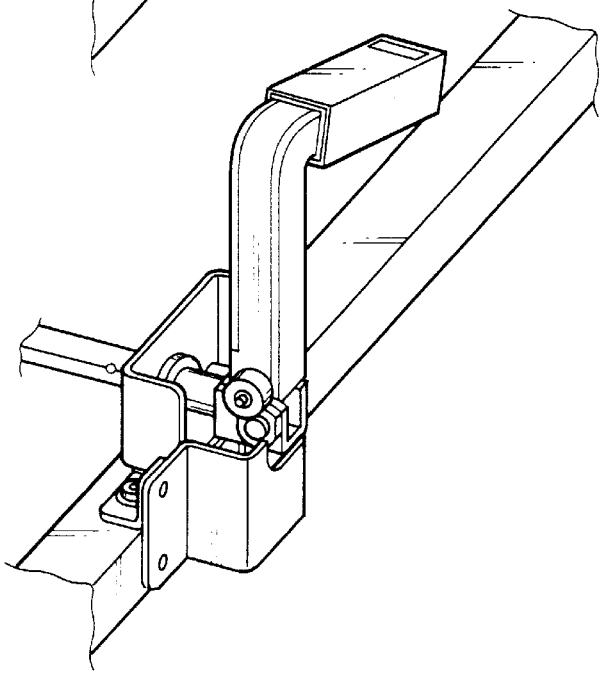
Figure 24:
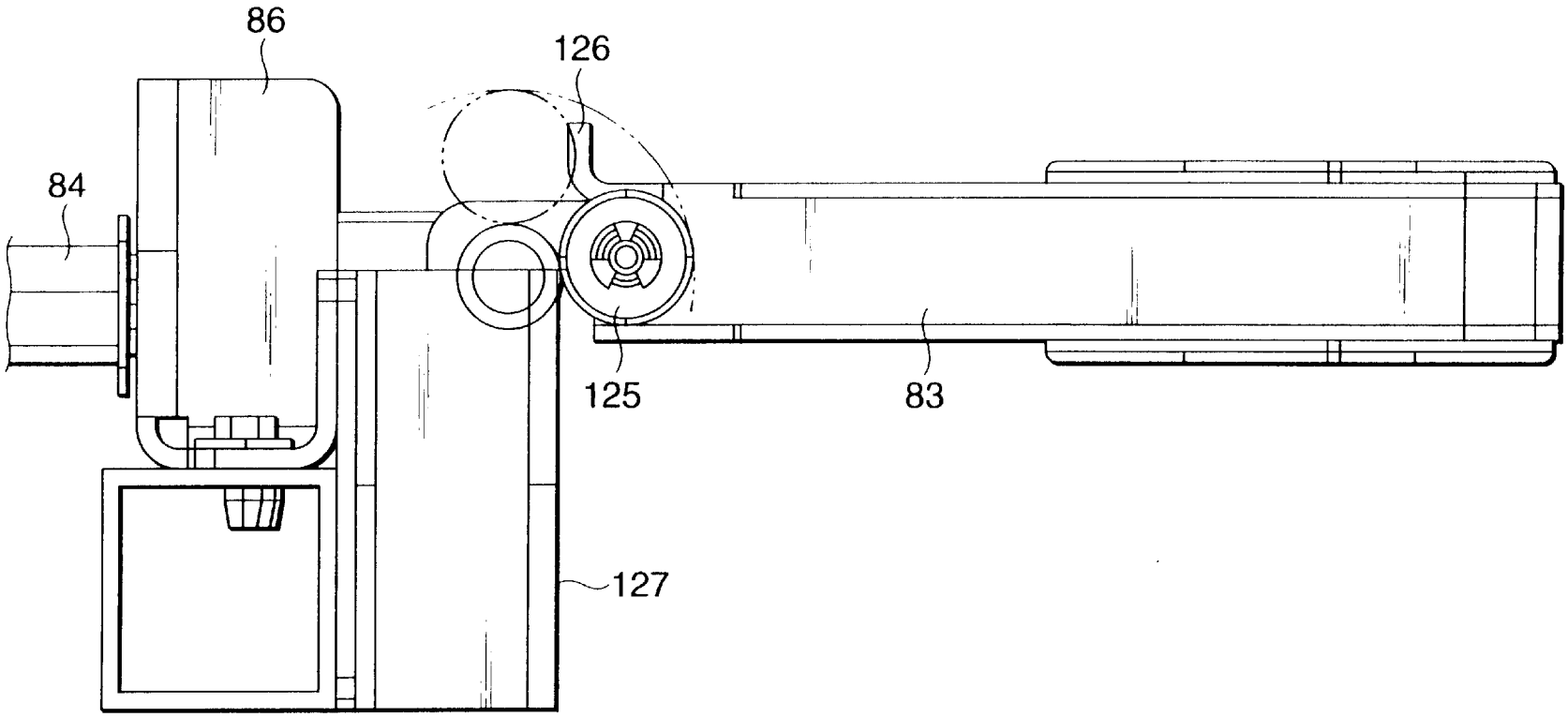
FIG. 24 is a side view of the handle folding mechanism.

Specifically, in this embodiment, when the second handle 83 is rotated 90 degrees clockwise as shown in FIG. 23A, a roller 125 rotatably attached to a bottom surface of the second handle 83 is horizontally oriented as a result of the rotation of the second handle 83, and the roller 125 is now movable along a semicircular metal regulating plate 126 for guidance as shown in FIG. 24. Until this state is established, the regulating plate 126 provided on one side of the second handle 83 at the base thereof abuts against a guard member 127 provided in front of the bearing plate 86 for rotatably supporting the handle 83 to disallow the handle 83 to be folded. Therefore, when the handle is folded upward while it is rotated 90 degrees clockwise as shown in FIGS. 23A, 23B and 23C, the roller 125 located at a side of the handle 83 rotates along the regulating plate 126, and the folding operation is completed when the handle is stopped in a state in which it is erected at 90 degrees.

Figure 25:
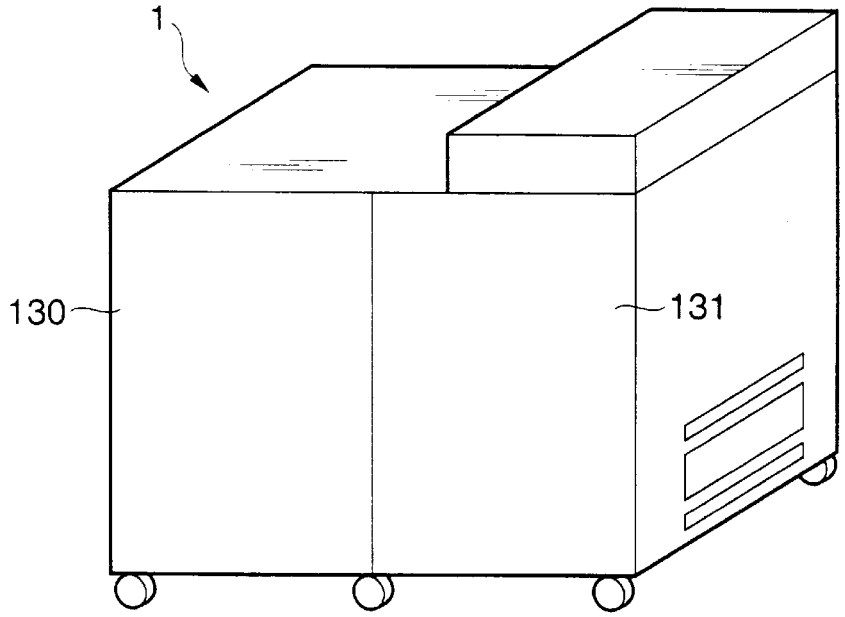
FIG. 25 is a perspective view of an image recorder main unit showing the appearance thereof.
Figure 26:
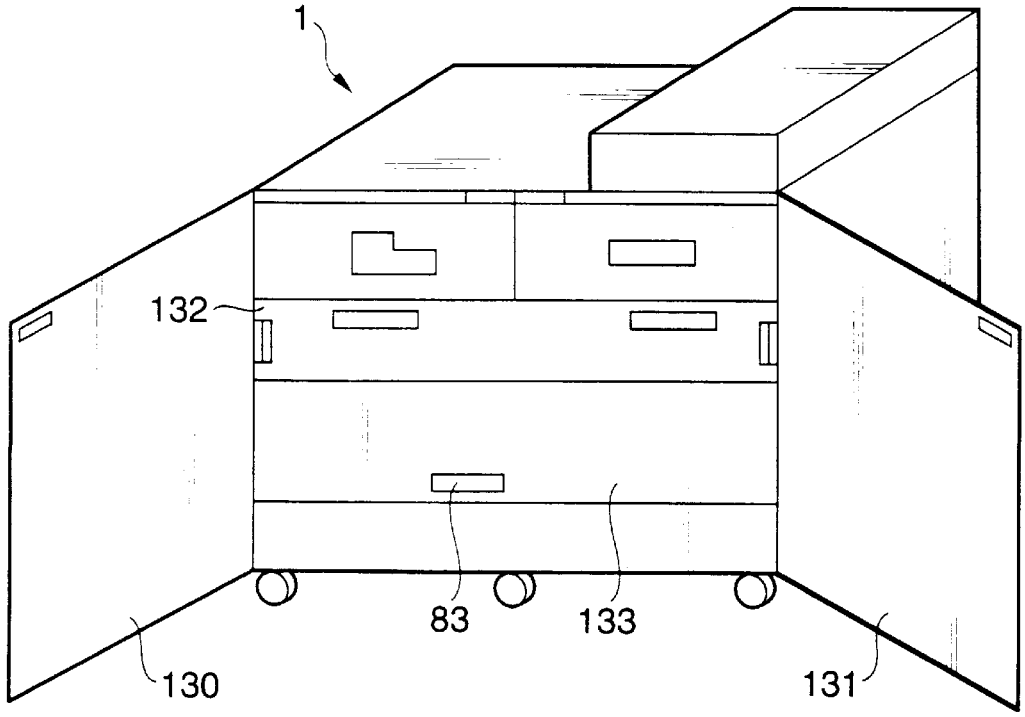
FIG. 26 is a perspective view of an image recorder main unit showing the appearance thereof.
Figure 27:
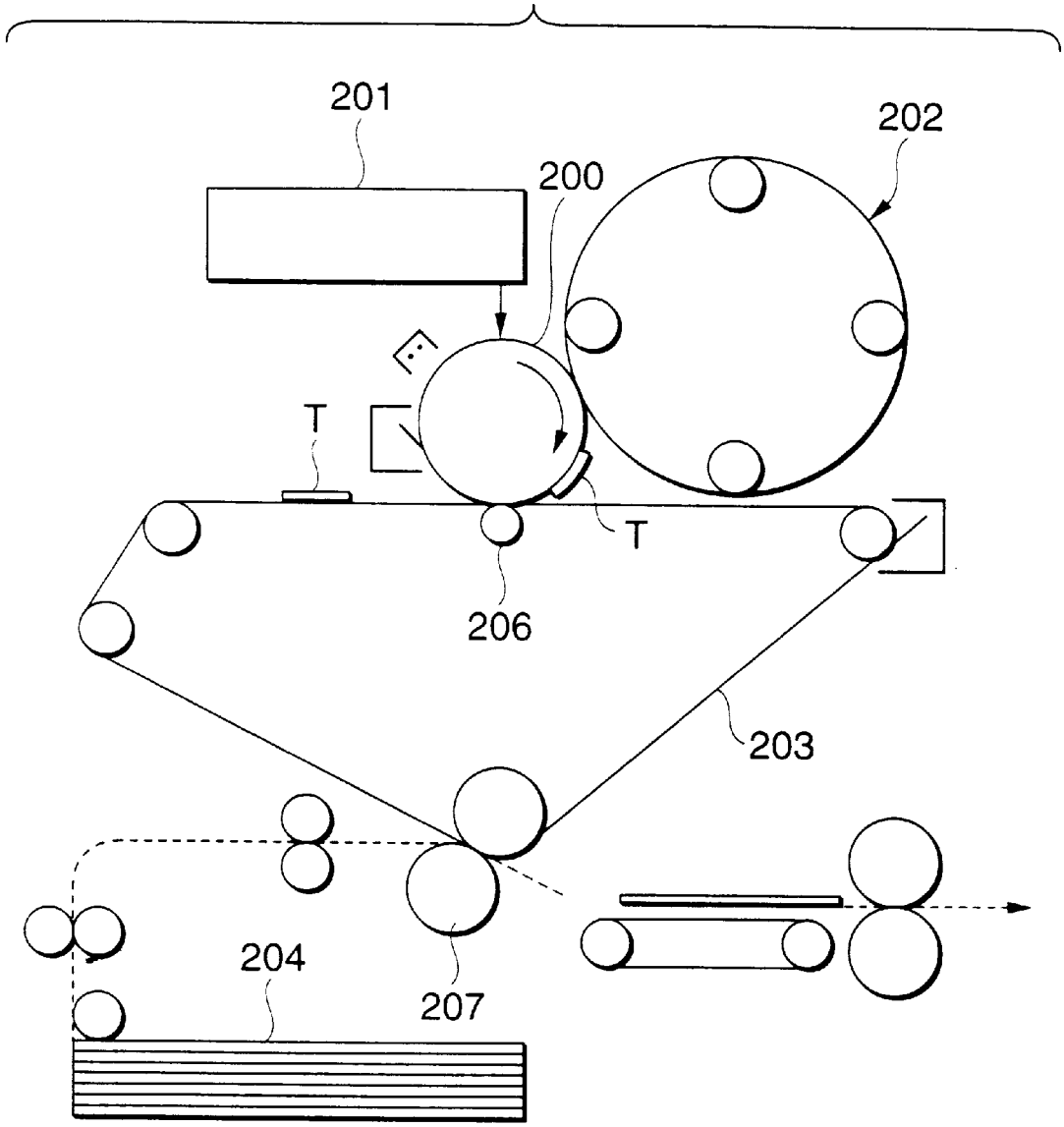
PRIOR ART FIG.27
FIG. 27 is a configuration diagram of an image forming apparatus according to the related art.
Figure 28:
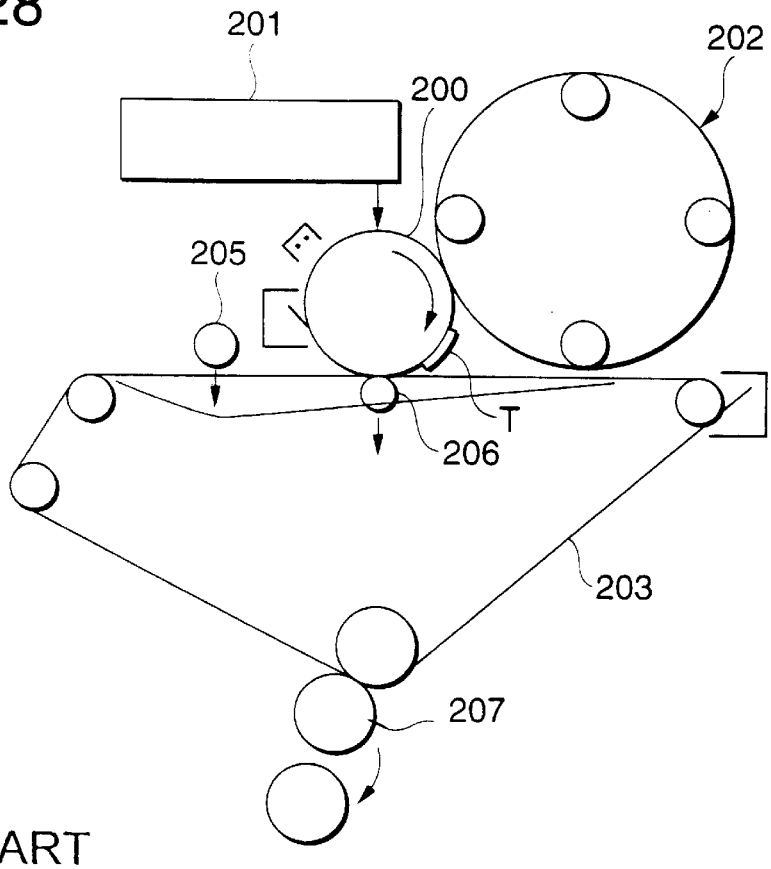
PRIOR ART FIG.28
FIG. 28 is a configuration diagram of the image forming apparatus according to the related art.
Figure 29:
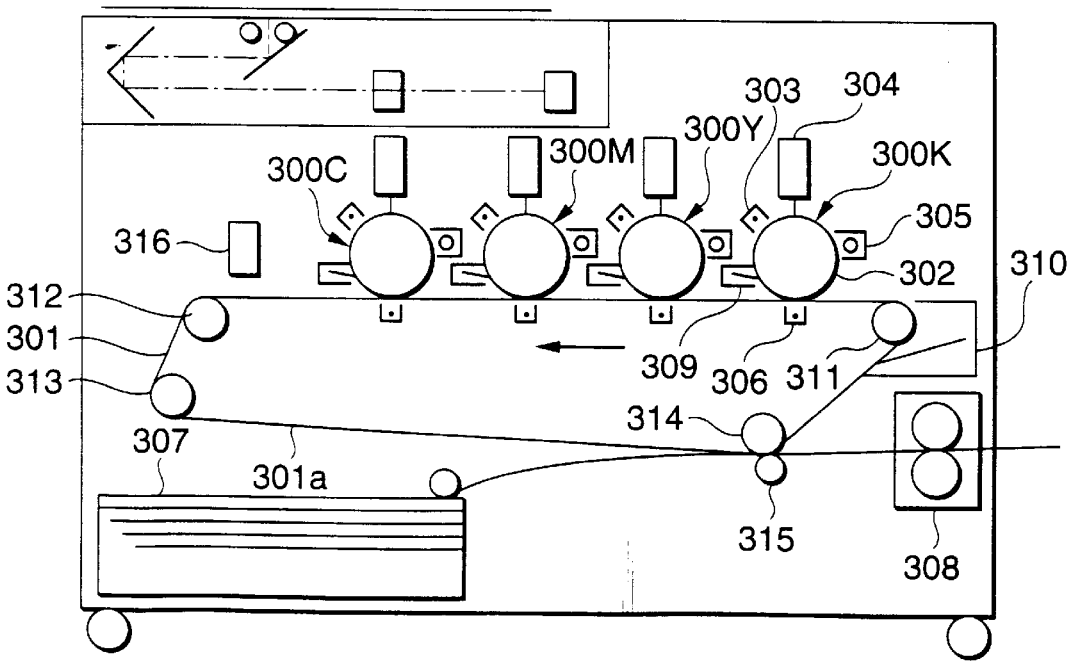
PRIOR ART FIG.29
FIG. 29 is a configuration diagram of the image forming apparatus according to the related art.
Figure 30:
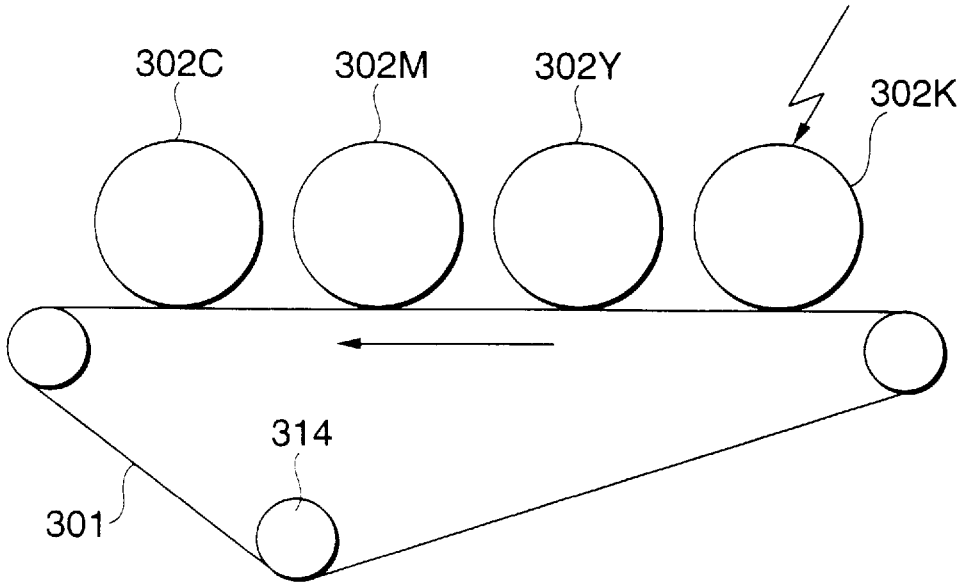
FIG.30 PRIOR ART
FIG. 30 is a configuration diagram of a major part of the image forming apparatus according to the related art.

In this embodiment, as shown in FIGS. 25 and 26, when front covers 130 and 131 of the image recorder main unit 1 are opened, only the second handle 83 which is the second retracting unit 81 is exposed. The belt module 60, secondary transfer module 80 and the like arc covered by protective covers 132 and 133 to prevent a user from operating the first retracting unit 64 and the like by mistake.

In a digital color copier according to the embodiment having a configuration as described above which is a so-called tandem type image forming apparatus having plural image carrying bodies and an intermediate transfer belt, it is possible as described below to space the intermediate transfer belt from the image carrying bodies without causing any damage on the intermediate transfer belt.

In a digital color copier according to the embodiment, as described below, there is no possibility of damage on an intermediate transfer belt or the apparatus even when the intermediate transfer belt is held at two positions, i.e., a position where it transfers image from image carrying bodies and a position where it is spaced from the image carrying bodies and pulled out and a secondary transfer portion has a position where it transfers an image on to a recording material and a position where it is pulled out Further, in a digital color copier according to the embodiment, as described below, an operating force required to move the positions of an intermediate transfer belt and a secondary transfer portion can be reduced, and a mechanism for moving the positions of the intermediate transfer belt and secondary transfer portion can be simplified.

Specifically, as shown in FIGS. 2 and 3, in an image recorder main unit 1 of a digital color printer according to the embodiment, an intermediate transfer belt 25 must be retracted along with a secondary transfer module 80 such that it is spaced from all of photosensitive drums 12K, 12Y, 12M and 12C in the case of replacement or maintenance of the intermediate transfer belt 25, replacement of the photosensitive drums 12K, 12Y, 12M and 12C or maintenance of members in the neighborhood of the same.

An image recorder main unit 1 of a digital color printer according to the embodiment has a paper transport path 45 for transporting recording paper 33 on which an image is recorded, paper-absorbing transport belts 34 and 35, a fixing device 36, a paper-inverting transport member 47 and a paper-inverting transport path 50, and a trouble so-called "jam" associated with transportation of the recording paper 33 may occur, i.e., the recording paper 33 may be caught in the paper transport paths. The secondary transfer module 80 must be retracted in order to remove the jamming recording paper 33.

Specifically, in this embodiment, the front doors 130 and 131 of the image recorder main unit 1 of the digital color printer are opened, and the second handle 83 which is the second retracting unit 81 is operated in the reverse way that follows FIGS. 23C, 23B and then 23A to pull up the second handle 83. The second handle 83 is then operated to rotate it 90 degrees counterclockwise.

Then, the arm secured to the handle shaft 84 to which the second handle 83 is attached is similarly rotated 90 degrees counterclockwise as shown in FIG. 13, which moves the secondary transfer module 80 downward to space the secondary transfer roll 32 from the backup roll 30.

In this state, the locking units 102 and 103 of the slide structure 53 are released to allow the slide structure 53 to be pulled out in front of the image recorder main unit 1.

Next, the protective covers of the image recorder main unit 1 are opened, and the first handles 69 which are the first retracting unit 64 are rotated in the direction indicated by the arrow as shown in FIGS. 4 and 5. As a result, the belt module 60 is moved downward to allow the intermediate transfer belt 25 to be retracted such that it is spaced from all of the photosensitive drums 12K, 12Y, 12M and 12C.

When the first handles 69 which are the first retracting unit 64 are operated in an attempt to lower the belt module 60 before the second transfer module 80 is moved downward with the second handle 83 which is the second retracting unit 81, as shown in FIG. 14, the lower ends 75*a* of the auxiliary handles 75 cooperating with the first handles 69 abut against the abutting members 90 provided on the secondary transfer module 80. This inhibits the rotation of the first handles 69, thereby preventing an erroneous operation.

As described above, the above embodiment has a configuration in which the retracting units 64 and 81 for retracting the belt module 60 along with the secondary transfer module 80 such that the intermediate transfer belt 25 is spaced from all of the photosensitive drums 12K, 12Y, 12M and 12C. It is therefore possible to space the intermediate transfer belt 25 from all of the photosensitive drums 12K, 12Y, 12M and 12C with the retracting units 64 and 81, which allows the intermediate transfer belt 25 to be spaced from the photosensitive drums 12K, 12Y, 12M and 12C without any damage on the intermediate transfer belt 25.

Further, the above embodiment has a configuration including the first retracting unit 64 for retracting the belt module 60 such that the intermediate transfer belt 25 is spaced from all of the photosensitive drums 12K, 12Y, 12M and 12C and the second retracting unit 81 for retracting the secondary transfer module 80 such that the secondary transfer roll 32 is spaced from the backup roll 30. It is therefore possible to prevent the second transfer module 80 from hindering the first retracting unit 64 from spacing the intermediate transfer belt 25 from all of the photosensitive drums 12K, 12Y, 12M and 12C.

Further, the above embodiment has a configuration including the first pull-out unit 77 for pulling out the belt module 60 from the image recorder main unit 1 and the second pull-out unit 56 for pulling out the secondary transfer module 80 from the image recorder main unit 1. As a result, the possibility of damage on the intermediate transfer belt 25 or the apparatus can be avoided even when the intermediate transfer belt 25 is held at two positions, i.e., a position where it transfers images from the photosensitive drums 12K, 12Y, 12M and 12C and a position where it is spaced from the photosensitive drums 12K, 12Y, 12M and 12C and pulled out and the secondary transfer portion has a position where it transfers images on to a recording material and a position where it is pulled out.

Furthermore, the above embodiment has a configuration in which the first retracting unit 64 retracts the belt module 60 such that the intermediate transfer belt 25 is spaced from all of the photosensitive drums 12K, 12Y, 12M and 12C after the secondary transfer module 80 is retracted by the second retracting unit 81 such that it is spaced from the backup roll 30. As a result, the first retracting unit 64 can prevent the secondary transfer module 80 from hindering the belt module 60 from spacing the intermediate transfer belt 25 from all of the photosensitive drums 12K, 12Y, 12M and 12C.

Further, the above embodiment has a configuration including the erroneous operation preventing unit 89 which prevents the operation of the first retracting unit 64 to retract the belt module 60 such that the intermediate transfer belt 25 is spaced from all of the photosensitive drums 12K, 12Y, 12M and 12C before the secondary transfer module 80 is retracted by the second retracting unit 81 such that the secondary transfer roll 32 is spaced from the backup roll 30. As a result, the erroneous operation preventing unit 89 can prevent the first retracting unit 64 from erroneously retracting the belt module 60 first, thereby preventing the belt module 60 from striking against other members to cause damage thereon.

The above embodiment has a configuration in which the erroneous operation preventing unit 89 disables the operation of the first retracting unit 64 to retract the belt module 60 such that intermediate transfer belt 25 is spaced from all of the photosensitive drums 12K, 12Y, 12M and 12C unless the secondary transfer module 80 is retracted by the second retracting unit 81 such that it is spaced from the backup roll 30. As a result, the erroneous operation preventing unit 89 can prevent the first retracting unit 64 from erroneously retracting the belt module 60 first, thereby preventing the belt module 60 from striking against other members to cause damage thereon with improved reliability.

Furthermore, the above embodiment has a configuration in which the erroneous operation preventing unit 89 is constituted by the auxiliary handles 79 of the first retracting unit 64 which retracts the belt module 60 such that the intermediate transfer belt 25 is spaced from all of the photosensitive drums 12K, 12Y, 12M and 12C and the abutting members 90 provided on the secondary transfer module 80. It is therefore possible to more reliably prevent the belt module 60 from striking against other members to cause damage thereon without a complicated configuration.

Further, the above embodiment has a configuration in which the handle members 69 of the first retracting unit 64 are provided in the vicinity of a positioning portion of the belt module 60. It is therefore possible to reduce an operating force required to move the intermediate transfer belt 25 and secondary transfer portion.

Further, the above embodiment has a configuration in which the handle members 69 of the first retracting unit 64 are normally covered by the protective covers which are not opened and closed by a user. It is therefore possible to reliably prevent a user from erroneously operating the handle members 69 of the first retracting unit 64.

Figure 31:
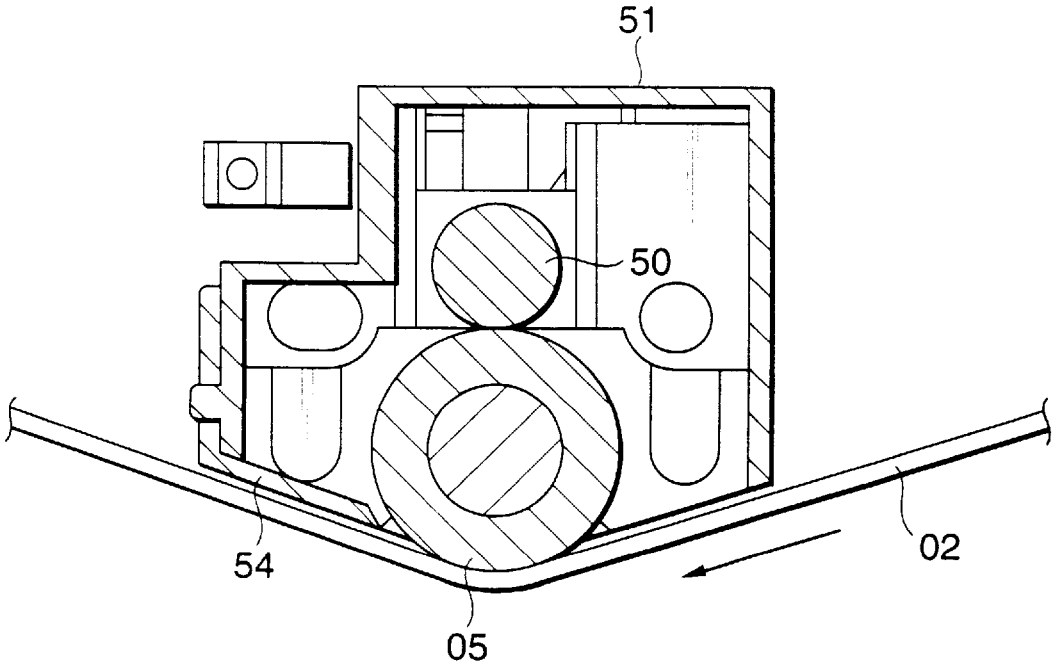
FIG. 31 is a sectional view of a casing containing a backup roll.

FIG. 31 shows a casing 51 in which a backup roll 05 is contained. An opening is formed on the bottom of the casing 51 to expose the backup roll 05 toward the intermediate transfer belt 02, and a circumferential surface of the backup roll 05 slightly protrudes from the casing 51 to prevent interference between the intermediate transfer belt 02 and casing 51.

A substantially L-shaped antistatic plate 54 grounded adjacent to the backup roll 05 on one side of the opening eliminates static electricity to encourage a recording sheet P to peel off the intermediate transfer belt 02.

It also makes it possible to prevent scattering of toner which has been subjected to primary transfer on to the intermediate transfer belt upstream of the secondary transfer portion under influence of electric fields at a contact roll 50, the backup roll 05 and the like. In addition, since the backup roll 05 is supported by the casing 51, they can be treated as a unit, which makes it possible to detach the casing from the module using a rail (not shown) for easy operation and replacement even if the backup roll is worn as a result of rotation.

As described above, the present invention makes it possible to provide a so-called tandem type image forming apparatus having plural image carrying bodies and an intermediate transfer belt, in which the intermediate transfer belt can be spaced from the image carrying bodies without causing any damage on the intermediate transfer belt.

The present invention also makes it possible to provide an image forming apparatus free from the possibility of damage and the like of the intermediate transfer belt and the apparatus even when it has a configuration in which an intermediate transfer belt is held at two positions, i.e., a position where it transfers an image from an image carrying body and a position where it is spaced from the image carrying body and pulled out and in which a secondary transfer portion has a position where it transfers an image on to a recording material and a position where it is pulled out.

The present invention also makes it possible to provide an image forming apparatus in which an operating force for moving the positions of an intermediate transfer belt and a secondary transfer portion can be reduced and in which a mechanism for moving the positions of the intermediate transfer belt and the secondary transfer portion can be simplified.

According to the present invention, a toner image which has been subjected to secondary transfer from an intermediate transfer belt to a recording sheet can be maintained at preferably quality, and a recording sheet having a toner image which has been subjected to secondary transfer can be reliably peeled off from the intermediate transfer belt.

Further, since the casing is detachable, the backup roll can be easily replaced together with the casing in the case of a trouble such as deterioration of the backup roll.

What is claimed is:

1. An image forming apparatus comprising:

a plurality of image carrying bodies which carry visible images that are formed using charged colorants in colors different from each other;

a belt-shaped intermediate transfer body to which primary transfer of the visible images carried by the plurality of image carrying bodies is carried out and which circulates with the visible images formed of the charged colorants carried thereon;

a secondary transfer member which transfers the visible images transferred onto the belt-shaped intermediate transfer body to a recording material;

a belt module which supports the belt-shaped intermediate transfer body such that it can circulate;

a secondary transfer module which supports the secondary transfer member such that it is urged into contact with or close to the belt-shaped intermediate transfer body supported by the belt module; and a retracting unit which retracts the belt module along with the secondary transfer module such that the belt-shaped intermediate transfer body is spaced from all of the image carrying bodies.

2. An image forming apparatus according to claim 1, wherein the retracting unit comprises:

a first retracting unit which retracts the belt module such that the belt-shaped intermediate transfer body is spaced from all of the image carrying bodies; and a second retracting unit which retracts the secondary transfer module such that the secondary transfer member is spaced from a position in contact with or close to the belt-shaped intermediate transfer body.

3. An image forming apparatus according to claim 1, further comprising:

a first pull-out unit which pulls out the belt module from a body of the image forming apparatus; and a second pull-out unit which pulls out the secondary transfer module from the body of the image forming apparatus.

4. An image forming apparatus according to claim 2, wherein the first retracting unit retracts the belt module such that the belt-shaped intermediate transfer body is spaced from all of the image carrying bodies after the secondary transfer module is retracted by the second retracting unit such that it is spaced from the belt-shaped intermediate transfer body.

5. An image forming apparatus according to claim 4, further comprising:

an erroneous operation preventing unit which prevents the first retracting unit from retracting the belt module such that the belt-shaped intermediate transfer body is spaced from all of the image carrying bodies before the secondary transfer module is retracted by the second retracting unit such that it is paced from the belt-shaped intermediate transfer body.

6. An image forming apparatus according to claim 5, wherein the erroneous operation preventing unit is configured to disable the first retracting unit from retracting the belt module such that the belt-shaped intermediate transfer body is spaced from all of the image carrying bodies unless the secondary transfer module is retracted by the second retracting unit such that it is spaced from the belt-shaped intermediate transfer body.

7. An image forming apparatus according to claim 6, wherein the erroneous operation preventing unit comprises:

a part of a handle member of the first retracting unit which retracts the belt module such that the belt-shaped intermediate transfer body is spaced from all of the image carrying bodies and a part of the secondary transfer module.

8. An image forming apparatus according to claim 7, wherein the handle member of the first retracting unit is provided in the vicinity of a positioning portion of the belt module.

9. An image forming apparatus according to claim 7, wherein the handle member of the first retracting unit is normally covered by a protective cover which is not opened and closed by a user.

10. An image forming apparatus comprising:

a plurality of image carrying bodies;

a belt-shaped intermediate transfer body to which primary transfer of visible images carried by the plurality of image carrying bodies is carried out and which circulates with the visible images carried thereon;

a belt module which supports the belt-shaped intermediate transfer body such that it can circulate;

a secondary transfer module which supports a secondary transfer member such that it is urged into contact with or close to the belt-shaped intermediate transfer body supported by the belt module;

a backup roll facing the secondary transfer member with the belt-shaped intermediate transfer body interposed therebetween, which supports the belt-shaped intermediate transfer body from a back side thereof;

an insulated casing which can be attached to and detached from the belt module, which is open at least in a region thereof facing the belt-shaped intermediate transfer body and which contains and supports the backup roll; and a retracting unit which retracts the belt module along with the secondary transfer module such that the belt-shaped intermediate transfer body is spaced from all of the image carrying bodies.

11. An image forming apparatus comprising:

an image carrying body on which a toner image according to image information is formed;

an intermediate transfer belt to which primary transfer of the toner image from the image carrying body is carried out;

a transfer member which performs secondary transfer of the toner image onto a recording sheet by nipping the recording sheet with the intermediate transfer belt and itself;

a backup roll disposed to face the transfer member with the intermediate transfer belt interposed therebetween, which supports the intermediate transfer belt from a back side thereof; and an insulated casing which is open at least in a region thereof facing the intermediate transfer belt and which contains and supports the backup roll.

12. An image forming apparatus according to claim 11, wherein the insulated casing and the backup roll contained in and supported by the insulated casing can be simultaneously attached and detached in an axial direction.

* * * * *